US006306001B1

(12) United States Patent
Hiroki

(10) Patent No.: US 6,306,001 B1
(45) **Date of Patent: *Oct. 23, 2001**

(54) METHODS FOR PRODUCING ELECTRON-EMITTING DEVICE, ELECTRON SOURCE, AND IMAGE-FORMING APPARATUS

(75) Inventor: Tamayo Hiroki, Zama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/301,159

(22) Filed: Apr. 28, 1999

(30) Foreign Application Priority Data

May 1, 1998 (JP) ..... 10-122521
Apr. 23, 1999 (JP) ..... 11-116594

(51) Int. Cl.[7] ..... H01J 9/02; H01J 1/316
(52) U.S. Cl. ..... 445/6; 445/24
(58) Field of Search ..... 445/6, 24

(56) References Cited

U.S. PATENT DOCUMENTS

| | | | |
|---|---|---|---|
| 3,896,016 | 7/1975 | Goodman et al. | 204/180 R |
| 5,066,883 | 11/1991 | Yoshioka et al. | 313/309 |
| 5,591,061 * | 1/1997 | Ikeda et al. | 445/6 |
| 5,674,100 | 10/1997 | Ono et al. | 445/24 |
| 6,123,876 | 9/2000 | Kobayashi et al. | 252/519.2 |

FOREIGN PATENT DOCUMENTS

| | | |
|---|---|---|
| 0716439 | 6/1996 | (EP) . |
| 2696443 | 4/1994 | (FR) . |
| 8-69747 | 3/1996 | (JP) . |
| 8-277294 | 10/1996 | (JP) . |
| 9-17333 | 1/1997 | (JP) . |
| 9-274851 | 10/1997 | (JP) . |
| 96-5733 | 2/1996 | (KR) . |
| 96-39062 | 11/1996 | (KR) . |

OTHER PUBLICATIONS

M. Hartwell, et al., "Strong Electron Emission From Patterned Tin–Indium Oxide Thin Films", International Electron Devices Meeting, pp. 519–521, 1975.
H. Araki, "Electroforming and Electron Emission of Carbon Thin Films", Journal of the Vacuum Society of Japan, vol. 26, No. 1, pp. 22–29, 1981.
G. Dittmer, "Electrical Conduction and Electron Emission of Discontinuous Thin Films", Thin Solid Films, vol. 9, pp. 317–328, 1972.
M. I. Elinson, et al., "The Emission of Hot Electrons and the Field Emission of Electrons from Tin Oxide", Radio Engineering and Electronic Physics, pp. 1290–1296, 1965.
C. A. Mead, "Operation of Tunnel–Emission Devices", Journal of Applied Physics, vol. 32, No. 4, pp. 646–652, 1961.

(List continued on next page.)

*Primary Examiner*—Kenneth J. Ramsey
(74) *Attorney, Agent, or Firm*—Fitzpatrick, Cella, Harper & Scinto

(57) ABSTRACT

An electron-emitting device is provided with stable electron emission characteristics and with uniformity of electron emission. The present invention thus provides a method for producing an electron-emitting device having a pair of device electrodes opposed to each other and a thin film including an electron-emitting region, formed on a substrate, wherein a voltage is applied so that a potential of a front surface of the substrate becomes higher than a potential of the back surface thereof. On that occasion, the strength of the electric field is not more than 20 kV/cm between the front surface and the back surface of the substrate. The substrate is heated during the application of the voltage.

68 Claims, 21 Drawing Sheets

OTHER PUBLICATIONS

C. A. Spindt, et al., "Physical Properties of Thin–Film Field Emission Cathodes with Molybdenum Cones", Journal of Applied Physics, vol. 47, No. 12, pp. 5248–5263, 1976.

W. P. Dyke, et al., "Field Emission", Advances in Electronics and Electron Physics, vol. VIII, 1956.

Japanese Patent Application 2584062 (Jul. 20, 1994) certified English translation.

* cited by examiner

METHODS FOR PRODUCING ELECTRON-EMITTING DEVICE, ELECTRON SOURCE, AND IMAGE-FORMING APPARATUS

BACKGROUND OF THE INVENTION

1. Field of the Invention

The present invention relates to a method for producing an electron-emitting device, a method for producing an electron source, and a method for producing an image-forming apparatus.

2. Related Background Art

Examples of the surface conduction electron-emitting devices include those disclosed in M. I. Elinson, et al., "The Emission of Hot Electrons and the Field Emission of Electrons From Tin Oxide Radio Eng. and Electronic Phys., 10, 1290 (1965), and so on.

The surface conduction electron-emitting devices utilize such a phenomenon that electron emission occurs when electric current is allowed to flow in parallel to the surface in a thin film of a small area formed on a substrate. Examples of the electron-emitting devices reported heretofore include those using a thin film of $SnO_2$ by Elinson et al. cited above, those using a thin film of Au G. Dittmer: Electrical Conduction and Electron Emission of Discontinuous Thin Films, Thin Solid Films, 9, 317 (1972), those using a thin film of $In_2O_3/SnO_2$ [M. Hartwell and C. G. Fonstad, "Strong Electron Emission From Patterned Tin-Indium Oxide Thin Films," International Electron Devices Meeting, 519, (1975)], those using a thin film of carbon [Hisashi Araki et al.: "Electroforming and Electron Emission of Carbon Thin Films," Journal of the Vacuum Society of Japan, 26, No. 1, p22 (1983)], and so on.

A typical example of these electron-emitting devices is the device structure of M. Hartwell cited above, which is schematically shown in FIG. 19. In FIG. 19, an electrically conductive, thin film 4 is formed on a substrate 1. The electrically conductive, thin film 4 is, for example, a thin film of a metallic oxide formed by sputtering in an H-shaped pattern and an electron-emitting region 5 is formed therein by an energization operation called energization forming. In the drawing the gap L between the device electrodes is set to 0.5 to 1 mm and the width W' to 0.1 mm.

The surface conduction electron-emitting devices described above have an advantage of allowing the capability of readily forming an array of many devices across a large area because of their simple structure and easy production. A variety of applications have been studied heretofore in order to take advantage of this feature. For example, they are applied to charged beam sources, image-forming apparatus (display devices), and so on. An example of the application to formation of an array of many surface conduction electron-emitting devices is, as described below, an electron source comprised of a lot of rows, each row being formed by arraying the electron-emitting devices in parallel and connecting both ends of the individual devices by wires (which will also be referred to as common wires). Particularly, as image-forming apparatus (display devices) or the like, the flat panel type image-forming devices (display devices) using liquid crystal are becoming widespread while replacing the CRTs, but they had problems including the need to have a back light, because they were not self-emission type devices. There have been, therefore, desires for development of self-emission type image-forming devices (display devices). An example of self-emission type image-forming devices (display devices) is an image-forming apparatus, which is an image-forming device (display device) constructed in the form of a combination of an electron source having an array of many surface conduction electron-emitting devices with a fluorescent member for emitting visible light upon reception of electrons emitted from the electron source (for example, U.S. Pat. No. 5,066,883).

In order to produce the large-area electron source substrate and the image-forming apparatus at low cost, it is necessary to decrease the cost of the members used therein. For this reason, a conceivable measure is to use as a substrate an alkali-containing glass such as soda lime glass or the like, which is an inexpensive material.

However, while such alkali-containing glasses were inexpensive on one hand, Na ions easily move, which sometimes posed a problem on the other hand.

For example, U.S. Pat. No. 3,896,016 discloses the problem of Na ions in the application of soda lime glass to the substrate of the liquid crystal display devices. In this application the electrodes are placed on both front and back surfaces of soda lime glass and an electric field is applied at the same time as heating. This operation decreases Na ions in one surface of the soda lime glass, so as to suppress influence thereof to the liquid crystal.

Japanese Laid-open Patent Application No. 9-17333 discloses a problem in the surface conduction electron-emitting device where on a glass substrate containing an alkali such as Na or the like, the device electrodes are formed with a paste containing sulfur and an organometal. Specifically, the Japanese application discloses that the aforementioned paste is printed and baked on the substrate of alkali-containing glass such as soda lime glass or the like whereby a compound containing Na and sulfur is deposited on the surface of the device electrodes. Further, the Japanese application also discloses that this compound makes an unstable electrical connection between the conductive film and the device electrodes. Disclosed as a means for solving it is a process having steps of forming the device electrodes, thereafter cleaning them together with the substrate, and then forming the electroconductive film thereon.

As described above, various means and ideas are often required where the alkali-containing glass (particularly, soda lime glass) is applied to electron devices.

FIG. 22A and FIG. 22B are schematic diagrams to show a conventional surface conduction electron-emitting device. FIG. 22A is a schematic plan view of the device and FIG. 22B is a schematic, sectional view of FIG. 22A. In the surface conduction electron-emitting device, the electroconductive film 4 on which an electron-emitting region 5 is placed is formed in contact with the surface of the substrate 1.

FIGS. 23A to 23D are schematic diagrams to show a method of producing the surface conduction electron-emitting device described above. The surface conduction electron-emitting device is made, for example, as follows.

First, electrodes 2, 3 are formed on the substrate 1 (FIG. 23A).

Next, the electroconductive film is formed so as to make a connection between the electrodes 2, 3 (FIG. 23B). The electroconductive film is formed after formation of the electrodes 2, 3 in this example, but there are also cases where the electrodes are formed after formation of the electroconductive film.

Subsequently, an energization forming step is carried out to energize the electroconductive film 4. The energization method is, for example, a method for energizing the electroconductive film 4 by applying such a voltage that a potential of one electrode out of the pair of electrodes described above becomes higher than a potential of the other electrode. This energization forms a small gap 11 in the conductive film (FIG. 23C).

Further, preferably, an energization activation step to energize the electroconductive film, similar to the above-stated forming step, is carried out in such a state that the region near the aforementioned gap part is in contact with an atmosphere in which an organic substance is present. This step is to form a carbon film 10 on the substrate in the gap 11 and on the electroconductive film 4 near the gap (FIG. 23D). The activation step results in forming a second gap 12 of the carbon film narrower than the gap 11, in the gap 11 formed by the aforementioned forming. The voltage applied in this activation step is preferably set to a voltage higher than the voltage applied in the above forming step in order to obtain the carbon film with higher quality.

The electron-emitting region 5 is formed through the above steps.

SUMMARY OF THE INVENTION

As described above, the energization operation is necessary for formation of the electron-emitting region 5 in the surface conduction electron-emitting device.

When the glass containing Na ions that easily move, such as the soda lime glass, was used as the above-stated substrate 1, there were, however, some cases in which the Na ions moved because of the electric field established during the above energization operation, so as to make the energization operation unstable.

Specifically, a conceivable reason is that part of the energy supplied with application of the voltage between the aforementioned pair of electrodes 2, 3 is dissipated in the substrate 1 because of the effects including superposition of conduction (direct current) in the substrate due to the movement of Na ions, energy loss due to dielectric polarization (dielectric loss), generation of internal electromotive force, and so on.

This sometimes resulted in losing repeatability of the distance and shape of the gap 11 formed by the energization forming. In cases where a plurality of electron-emitting devices were formed on the substrate 1, there were sometimes variations in the shape and distance of the gap 11 among the devices and uniformity was thus poor.

When such a device was further subjected to the energization activation step, no repeatability was achieved in the thickness and shape of the carbon film 10 formed on the electroconductive film 4 and in the gap part 11 and thus desired electron emission characteristics were not achieved in certain cases. In cases where a plurality of electron-emitting devices were formed on the substrate 1, there were sometimes variations or the like in the thickness of the carbon film and in the distance of the second gap 12 formed of the carbon film, in addition to the variations among the devices having occurred in the aforementioned energization forming.

When there arose the difference in the shape of the electron-emitting regions 5 among the devices as described above, an electron source obtained would be one with nonuniform electron emission characteristics.

In an image-forming apparatus using such an electron source, the aforementioned irregularities would result in nonuniformity of luminance, and pixel defects or the like in the worst case, in turn degrading the quality of display.

An object of the present invention is, therefore, to provide a novel method for suppressing the influence of the Na ions during the energization operation.

In order to accomplish the above object, the present invention is characterized by a method for producing an electron-emitting device, the method comprising:

- a step of preparing a sodium-containing substrate having a first principal surface and a second principal surface opposed to each other;
- a step of forming an electroconductive film placed on the first principal plane;
- an electric field application step of applying such an electric field that a potential of the first principal surface with said electroconductive film thereon becomes higher than a potential of said second principal surface; and
- a step of carrying out an energization operation of the electroconductive film after the electric field application step.

When this method for producing the electron-emitting device is applied, the Na ions can be made to move from the first principal surface side, on which the electroconductive film is formed, to the back surface side of the substrate.

Therefore, electric migration of the Na during the energization operation can be suppressed by carrying out the energization operation after the electric field application step. As a result, the energization operation for the electroconductive film, such as the energization forming operation, the energization activation operation, or the like, carried out after the electric field application step can be carried out on a stable basis and this permits us to obtain the electron-emitting device, the electron source, and the image-forming apparatus with excellent repeatability and uniformity.

The strength of the electric field applied in the electric field application step is preferably not more than 20 kV/cm.

The electric field application step is preferably carried out in a state in which the substrate is heated. When the electric field application step is carried out upon heating the substrate, the movement of Na ions is promoted, so that the time necessary for the movement of the Na ions can be decreased.

The above heating method can be any method; for example, heating can be achieved by placing a heating means such as a heater in close contact with the second principal surface. Another means for heating is to place the substrate in a heating means such as a furnace for heating the entire substrate.

In a method for producing an electron source having an array of electron-emitting devices, the aforementioned electric field application step is preferably a step of applying such a voltage that a potential applied to a plurality of wires for driving the electron-emitting devices is different from a potential applied to electrodes placed on the second principal surface.

In a method for producing an image-forming apparatus comprising an electron source having an array of electron-emitting devices, and an image-forming member, it is preferable to carry out the aforementioned electric field application step at the same time as heating in a sealing step of a vessel forming the image-forming apparatus.

Further, where the vessel is also heated during evacuation of the inside of the vessel to a depressurized state after the sealing step, it is preferable to apply the aforementioned electric field during this heating as well.

DETAILED DESCRIPTION OF THE PREFERRED EMBODIMENTS

Figure 1A:
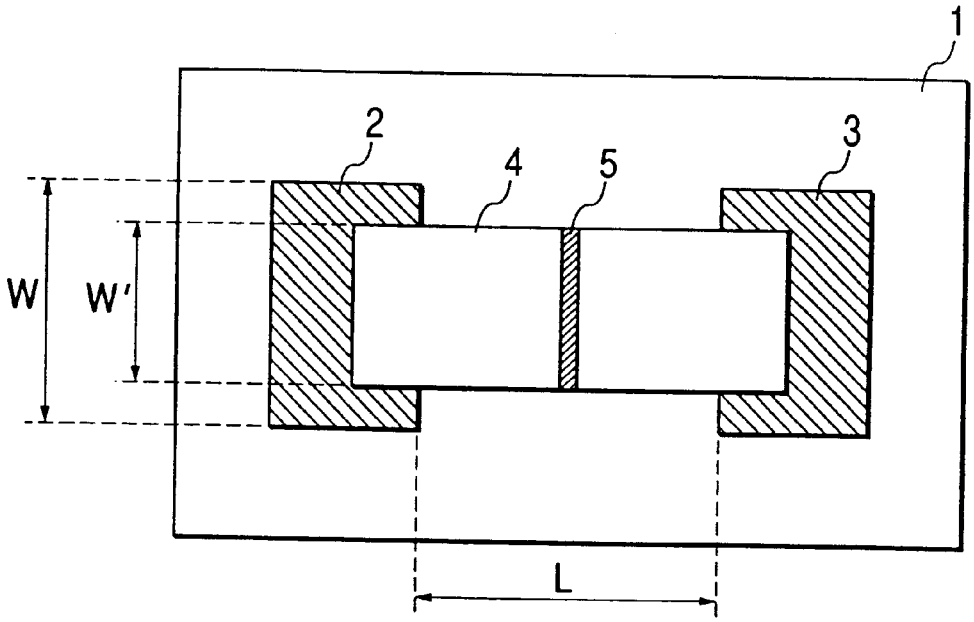
FIG. 1A and FIG. 1B are schematic diagrams of an electron-emitting device produced in Example 1.
Figure 1B:
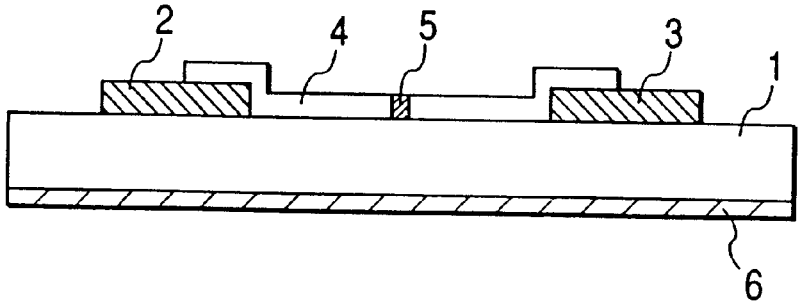

The present invention will be described with reference to the drawings. FIG. 1A and FIG. 1B are diagrams to show the features of the present invention best, which are schematic diagrams to show an example of the electron-emitting device according to the present invention.

In FIG. 1A, device electrodes 2, 3 and electroconductive film 4 are provided on the substrate 1. There is a back electrode 6 on the back surface of the substrate, as illustrated in FIG. 1B.

FIGS. 1A and 1B are the schematic diagrams to show the structure of the electron-emitting device to which the present invention can be applied, wherein FIG. 1A is a plan view of the device and FIG. 1B is a sectional view of the device.

In FIG. 1A, there are provided the electrodes 2, 3, electroconductive film 4, and electron-emitting region 5 on the substrate 1 and the back electrode 6 on the back surface of the substrate 1 (FIG. 1B). The electrodes 2 and 3 are provided for forming suitably an electrical energizing of the electroconductive film 4. However, in a case that the energization of the conductive film 4 can be suitably performed without the electrodes 2 and 3, the electrodes 2 and 3 are not necessarily required.

The substrate 1 is a glass substrate containing sodium. In particular, a cheaper soda lime glass may be used for the substrate. Further, in general, in order to improve a workability in producing the glass which may contain the sodium, the sodium is contained in several kinds of the glass material. For example, a boro-silicated glass substrate containing sodium may also be used for the present invention. Also, a substrate produced by laminating $SiO_2$ on the glass by sputtering may be used. Wherein, by laminating $SiO_2$, a precipitation of Na compound from the substrate can be produced.

A material for the device electrodes 2, 3 opposed to each other can be an ordinary conductive material. It can be properly selected, for example, from metals such as Ni, Cr, Au, Mo, W, Pt, Ti, Al, Cu, Pd, and the like, alloys thereof, printed conductors composed of a metal or a metal oxide such as Pd, Ag, Au, $RuO_2$, Pd—Ag, or the like and glass or the like, transparent conductive materials such as $In_2O_3$—$SnO_2$ or the like, semiconductor/conductor materials such as polysilicon or the like, and so on.

The gap L between the device electrodes, the length W of the device electrodes, the shape of the conductive film 4, etc. are designed, taking an application form or the like into consideration. The device electrode gap L can be determined preferably in the range of several thousand angstroms to several hundred micrometers and more preferably in the range of several micrometers to several ten micrometers, taking the voltage placed between the device electrodes or the like into consideration.

The device electrode width W can be determined in the range of several micrometers to several hundred micrometers, taking the resistance of the electrodes and the electron emission characteristics into consideration.

In addition to the structure illustrated in FIGS. 1A and 1B, the device can also be constructed in such structure that the conductive film 4 and the opposed device electrodes 2, 3 are stacked in the stated order on the substrate 1.

The thickness of the conductive film 4 is properly determined, taking the step coverage over the device electrodes 2, 3, the resistance between the device electrodes 2, 3, the forming conditions described hereinafter, and so on into consideration. Normally, the thickness of the conductive film 4 is determined preferably in the range of several angstroms to several thousand angstroms and more preferably in the range of 10 angstroms to 500 angstroms. The surface resistance Rs of the conductive film 4 is preferably in the range of $10^2$ to $10^7$ Ω/□. The surface resistance Rs is a value appearing when a resistance R, which is measured in the direction of the length of a thin film having the thickness of t, the width of w, and the length of I, is set as R=Rs (I/w), and Rs=ρ/t where ρ is a resistivity.

The material for making the electroconductive film 4 is properly selected from metals such as Pd, Pt, Ru, Ag, Au, Ti, In, Cu, Cr, Fe, Zn, Sn, Ta, W, Pb, and so on, oxides such as PdO, $SnO_2$, $In_2O_3$, PbO, $Sb_2O_3$, and so on, borides such as $HfB_2$, $ZrB_2$, $LaB_6$, $CeB_6$, $YB_4$, $GdB_4$, and so on, carbides such as TiC, ZrC, HfC, TaC, SiC, WC, and so on, nitrides such as TiN, ZrN, HfN, and so on, semiconductors such as Si, Ge, and so on, carbon, and so on.

The electron-emitting region 5 is comprised of a gap formed in part of the electroconductive film 4 by the energization forming and, preferably, a carbon film placed on the substrate in the aforementioned gap and on the electroconductive film near the gap by energization activation described hereinafter. The gap is dependent on the thickness, quality, material and techniques of the energization forming or the like described hereinafter of the electroconductive film 4, and so on. The carbon film can be one containing carbon and a carbon compound.

There are a variety of methods as methods for producing the electron-emitting device according to the present invention, among which an example is schematically shown in FIGS. 3A to 3D.

The example of the production method will be described referring to FIGS. 1A and 1B and FIGS. 3A to 3D. In FIGS. 3A to 3D, the same portions as those in FIGS. 1A and 1B are denoted by the same reference numerals as those in FIGS. 1A and 1B.

First, the substrate 1 is cleaned well using a detergent, pure water, and an organic solvent or the like, and the material for the device electrodes is deposited on a first principal surface of the substrate 1 by vacuum evaporation, sputtering, or the like. Subsequently, the device electrodes 2, 3 are formed on the substrate 1, for example, by the photolithography technology. Then the back electrode 6 is formed on the back surface of the substrate by sputtering or the like (see FIG. 3A).

Figure 3A:
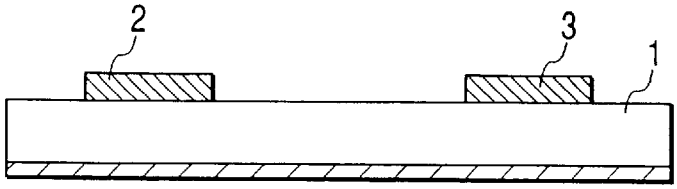
FIG. 3A, FIG. 3B, FIG. 3C, and FIG. 3D are schematic diagrams to show a production process according to the present invention.
Figure 3B:
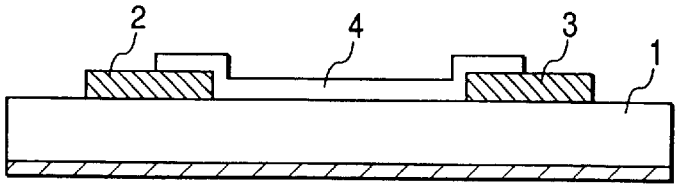

Next, an organometallic solution is applied onto the substrate 1 provided with the device electrodes 2, 3 to form a thin film of an organic metal. The organometallic solution can be a solution of an organometallic compound containing the principal element of the metal in the material of the conductive film 4 described above. The organometallic film is heated and baked and then is patterned by lift-off, etching, or the like, thereby forming the conductive film 4 (FIG. 3B). This example was described above with the application method of the organometallic solution, but the methods for forming the conductive film 4 do not always have to be limited thereto; for example, the conductive film 4 can also be formed by any one selected from the vacuum evaporation process, the sputtering process, the chemical vapor deposition process, the dispersion coating method, the dipping method, the spinner method, the ink jet method, and so on. The ink jet method is preferably used, because it can obviate the need for the patterning step described above.

Figure 3C:
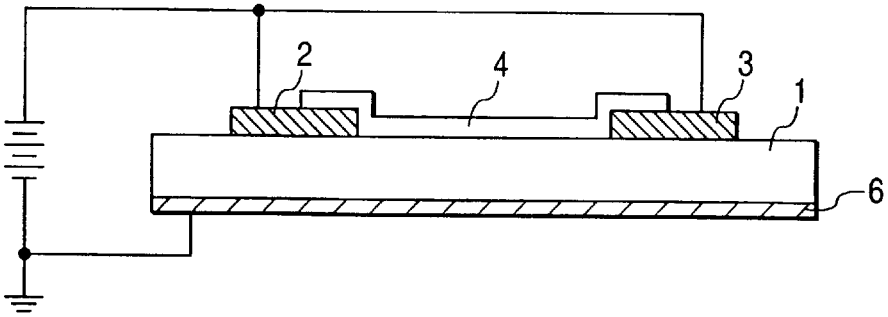

Next, a positive voltage with respect to the back electrode 6 is applied to the device electrodes 2, 3 in order to reduce Na ions in the surface of substrate 1 (FIG. 3C). An application method of the voltage can be a method for connecting the back surface of the substrate to the ground and applying the positive voltage to the front surface of the substrate or a method for connecting the surface of the substrate to the ground and applying a negative voltage to the back surface of the substrate. If the substrate is heated at this time the Na ions can be moved efficiently in a short time. The voltage applied is preferably determined in the range of the strength of the electric field not more than 20 kV/cm. When an electric field strength exceeds 20 kV/cm, a dielectric breakdown would likely be caused in the glass substrate. In such case, the element electrodes 2 and 3 and the back electrode 6 are also damaged. The necessary electric field strength is set according to an application period and a substrate temperature. As a value of the field strength, 10 V/cm or more higher is desirable practically. This voltage applying step can be carried out several times during the process for producing the electron-emitting device. This step is carried out preferably at the same time as another heating step.

Then the forming step is carried out. When energization is effected between the device electrodes 2, 3 by use of a power supply not illustrated, the gap is formed in part of the conductive film. Examples of voltage waveforms in the energization forming are illustrated in FIGS. 4A and 4B.

The waveforms of the voltage are preferably pulse waveforms. For applying such pulses, there are a method illustrated in FIG. 4A for continuously applying pulses with a pulse peak height of a constant voltage and a method illustrated in FIG. 4B for applying pulses with increasing pulse peak heights.

Figure 4A:
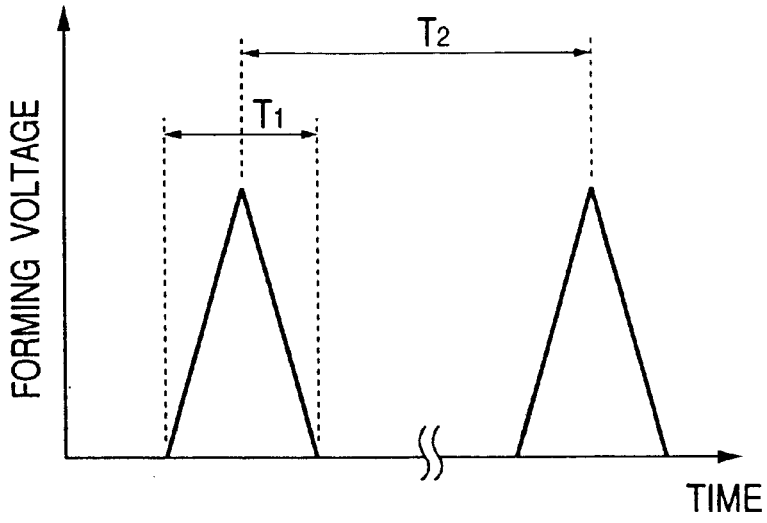
FIG. 4A and FIG. 4B show pulse waveforms used in the energization forming.

In FIG. 4A $T_1$ and $T_2$ represent the pulse width and pulse interval of voltage waveforms, respectively. Generally, $T_1$ is set in the range of 1 μsec to 10 msec and $T_2$ in the range of 10 μsec to 100 msec. The peak height (the peak voltage during the energization forming) of triangular waves is properly selected according to the form of the electron-emitting device. Under these conditions, the voltage is applied, for example, for several seconds to several ten seconds. The pulse waveforms are not limited to the triangular waves, but can be any desired waveforms such as rectangular waves and the like.

Figure 4B:
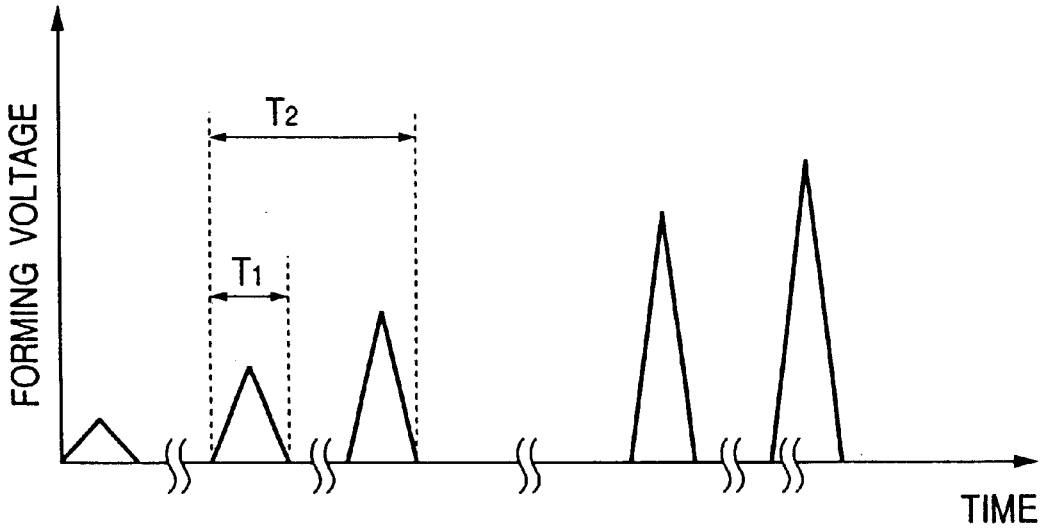

In FIG. 4B $T_1$ and $T_2$ can be the same as those in FIG. 4A. The peak heights (the peak voltages during the energization forming) of the triangular waves can be increased, for example, by steps of about 0.1 V.

The end of the energization forming operation can be detected in such a manner that a voltage too low to locally break or deform the conductive film 4 is applied during the pulse interval $T_2$ and the current flowing at that time is measured. For example, the energization forming is terminated when the device current is measured with application of the voltage of about 0.1 V and the resistance calculated therefrom is not less than 1 MΩ.

Next, the device after the energization forming is preferably subjected to an operation called an energization activation step. The activation step is a step by which the device current $I_f$ and emission current $I_e$ are changed remarkably.

Figure 3D:
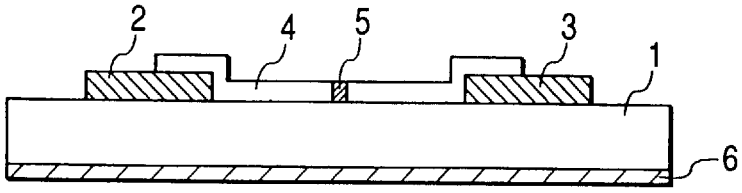
Figure 24:
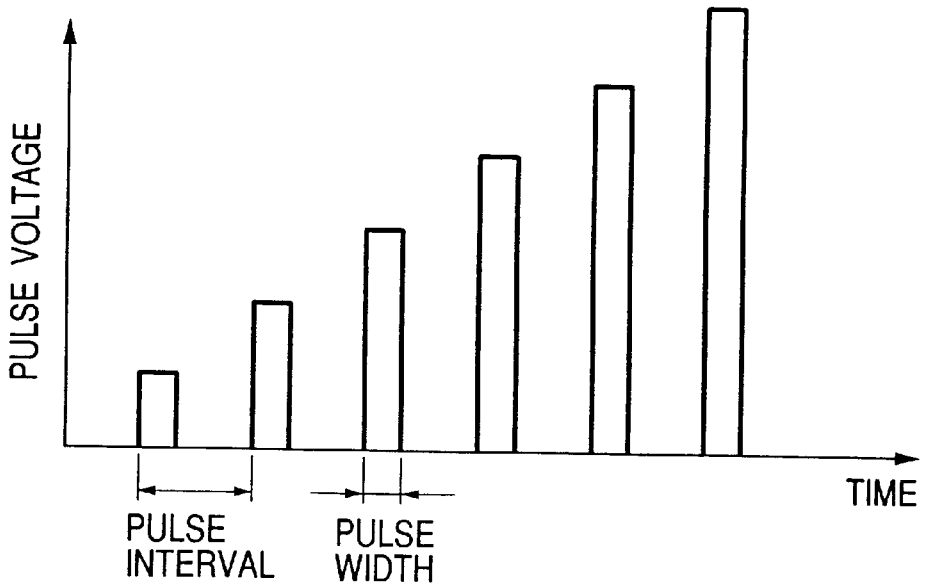
FIG. 24 is a diagram to show pulse waveforms that can be used in the energization step.
Figure 25:
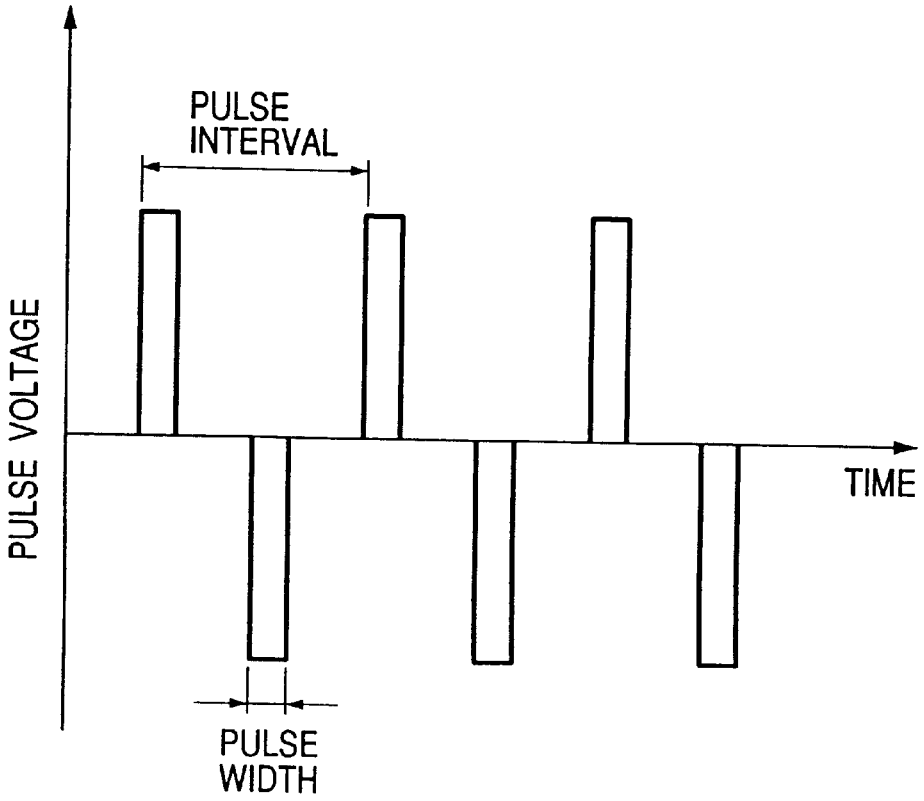
FIG. 25 is a diagram to show pulse waveforms that can be preferably used in the energization activation step.

The activation step can be carried out by repetitively applying pulses, similar to those in the energization forming, under an ambience containing a gas of an organic substance. In the energization activation step, pulses as shown in FIG. 24 or in FIG. 25 may also be applied. Particularly, it is preferable to apply the bipolar pulses shown in FIG. 25. This ambience can be established by making use of an organic gas remaining in the ambience where the inside of the vacuum vessel is evacuated using an oil diffusion pump or a rotary pump, for example. In addition, the ambience can also be obtained by introducing a gas of an appropriate organic substance into a vacuum achieved once by sufficient evacuation by means of an ion pump or the like. The preferred gas pressure of the organic substance at this time varies depending upon the application form described above, the shape of the vacuum vessel, the kind of the organic substance, etc. and is properly determined depending upon circumstances. Appropriate organic substances are aliphatic hydrocarbons of alkane, alkene, and alkyne, aromatic hydrocarbons, alcohols, aldehydes, ketones, amines, organic acids such as phenol, carboxylic acid, sulfonic acid, and the like, and so on. Specifically, the organic substances applicable include saturated hydrocarbons represented by $C_nH_{2n+2}$ such as methane, ethane, propane, and the like, unsaturated hydrocarbons represented by the composition formula of $C_nH_{2n}$ or the like such as ethylene, propylene, and the like, benzene, benzonitrile, toluene, methanol, ethanol, formaldehyde, acetaldehyde, acetone, methyl ethyl ketone, methylamine, ethylamine, phenol, formic acid, acetic acid, propionic acid, and so on. This operation causes carbon or a carbon compound to be deposited on the substrate within the gap formed in the above forming step and on the conductive film near the gap from the organic substance existing in the ambience. This step forms the electron-emitting region 5 (FIG. 3D).

The judgment of the end of the activation step is properly made while measuring the device current $I_f$ and the emission current $I_e$. The pulse width, the pulse interval, the pulse peak heights, etc. are properly determined as occasion may demand.

The carbon and carbon compound may include, for example, graphite (including so-called HOPG, PG, and GC; HOPG indicating nearly perfect graphite crystal structure, PG indicating slightly disordered crystal structure having the crystal grains of about 200 angstroms, and GC indicating much more disordered crystal structure having the crystal grains of about 20 angstroms) or non-crystalline carbon (indicating amorphous carbon and a mixture of amorphous carbon with fine crystals of the aforementioned graphite). The thickness of the carbon film is preferably in the range of not more than 500 angstroms and more preferably in the range of not more than 300 angstroms.

The electron-emitting device obtained through these steps is preferably subjected to a stabilization step. This step is a step of exhausting the organic substance from the vacuum vessel. A vacuum evacuation apparatus for evacuating the vacuum vessel is preferably one not using oil in order to prevent oil generated from the apparatus from affecting the characteristics of the device. Specifically, the vacuum evacuation apparatus can be selected from an absorption pump, an ion pump, and so on.

In cases where in the aforementioned activation step the oil diffusion pump or the rotary pump was used as an evacuation apparatus and the organic gas resulting from the oil component generated therefrom was used, it is necessary to keep the partial pressure of this component as low as possible. The partial pressure of the organic substance in the vacuum vessel should be a partial pressure under which the aforementioned carbon and carbon compound are prevented substantially from being deposited newly, which is preferably not more than $1\times10^{-8}$ Torr and particularly preferably not more than $1\times10^{-10}$ Torr. Further, during the evacuation of the inside of the vacuum vessel, it is preferable to heat the whole vacuum vessel so as to facilitate the exhaust of organic molecules adhering to the inside wall of the vacuum vessel and to the electron-emitting device. The heating condition at this time is preferably 80 to 200° C. for 5 hours or more, but the heating condition is not limited particularly to this condition. The heating is carried out under a condition properly selected according to various conditions including the size and shape of the vacuum vessel, the structure of the electron-emitting device, and so on. The pressure inside the vacuum vessel has to be set as low as possible, and is preferably not more than $1\times10^{-7}$ Torr and more preferably not more than $1\times10^{-8}$ Torr.

The ambience during driving of the electron-emitting device after completion of the stabilization step is preferably that at the time of completion of the above stabilization operation, but it is not limited to this. As long as the organic substance is removed well, sufficiently stable characteristics can be maintained even with a little degradation of the degree of vacuum itself.

New deposition of carbon or the carbon compound can be suppressed by employing such a vacuum ambience, so that the device current $I_f$ and the emission current $I_e$ become stable.

The basic characteristics of the electron-emitting device obtained through the aforementioned steps according to the present invention will be described below referring to FIG. 5 and FIG. 6.

Figure 5:
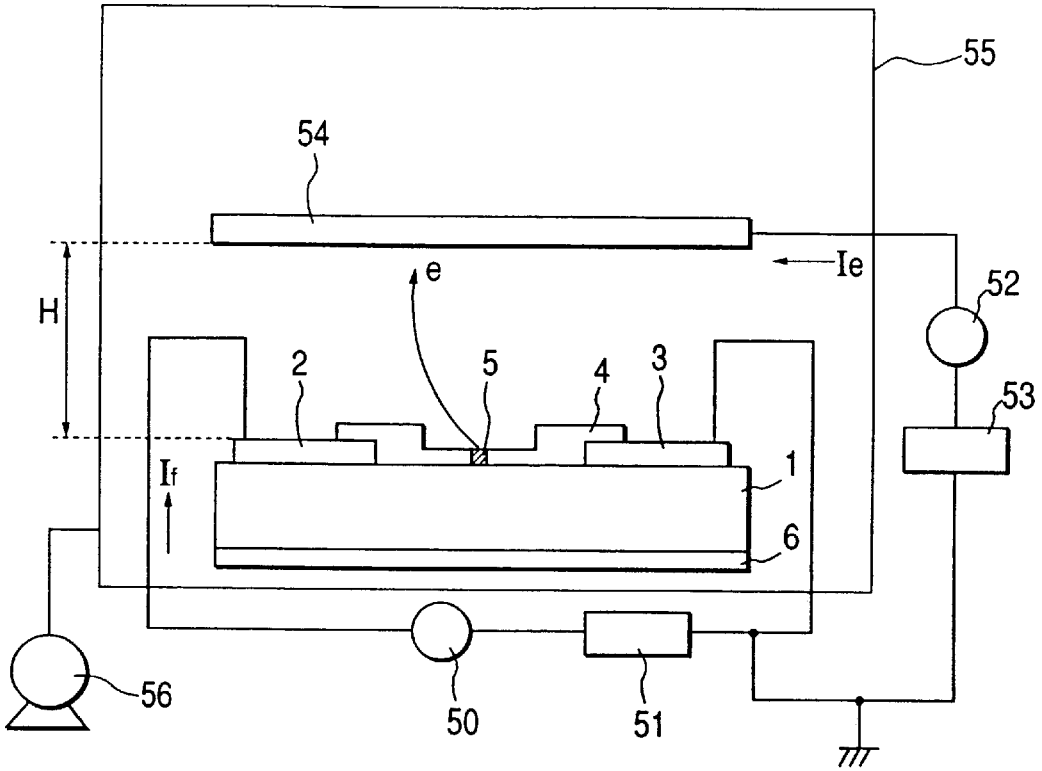
FIG. 5 is a schematic diagram of a device for measuring characteristics of the electron-emitting device of the present invention.

FIG. 5 is a schematic diagram to show an example of a vacuum process apparatus, and this vacuum process apparatus also has the function as a measuring and evaluating apparatus. In FIG. 5, the same portions as those illustrated in FIGS. 1A and 1B are denoted by the same reference symbols as those in FIGS. 1A and 1B. In FIG. 5, a vacuum vessel 55 is evacuated by an exhaust pump 56. The electron-emitting device is placed in the vacuum vessel 55. Namely, there are the device electrodes 2, 3, the conductive film 4, and the electron-emitting region 5 formed on the substrate 1 for the electron-emitting device. Further, there are provided a power supply 51 for applying the device voltage $V_f$ to the electron-emitting device, an ammeter 50 for measuring the device current $I_f$ flowing in the conductive film 4 between the device electrodes 2, 3, and an anode electrode 54 for capturing the emission current $I_e$ emitted from the electron-emitting region of the device. There are also provided a high-voltage power supply 53 for applying a voltage to the anode electrode 54, and an ammeter 52 for measuring the emission current $I_e$ emitted from the electron-emitting region 5. As an example, measurement can be carried out under such conditions that the voltage of the anode electrode 54 is set in the range of 1 kV to 10 kV and the distance H between the anode electrode 54 and the electron-emitting device is in the range of 2 mm to 8 mm.

Equipment necessary for measurement under a vacuum atmosphere, such as a vacuum gage or the like (not illustrated), is provided in the vacuum vessel 55 and is adapted to perform the measurement and evaluation under a desired vacuum atmosphere. The exhaust pump 56 is composed of an ordinary high vacuum system consisting of a turbo pump, a rotary pump, etc. and, further, an ultra-high vacuum system consisting of an ion pump, etc. The whole of the vacuum process apparatus in which the electron source substrate is placed, illustrated herein, can be heated up to 200° C. by a heater not illustrated. Therefore, the steps of the aforementioned energization forming and after can also be performed using this vacuum process apparatus.

Figure 6:
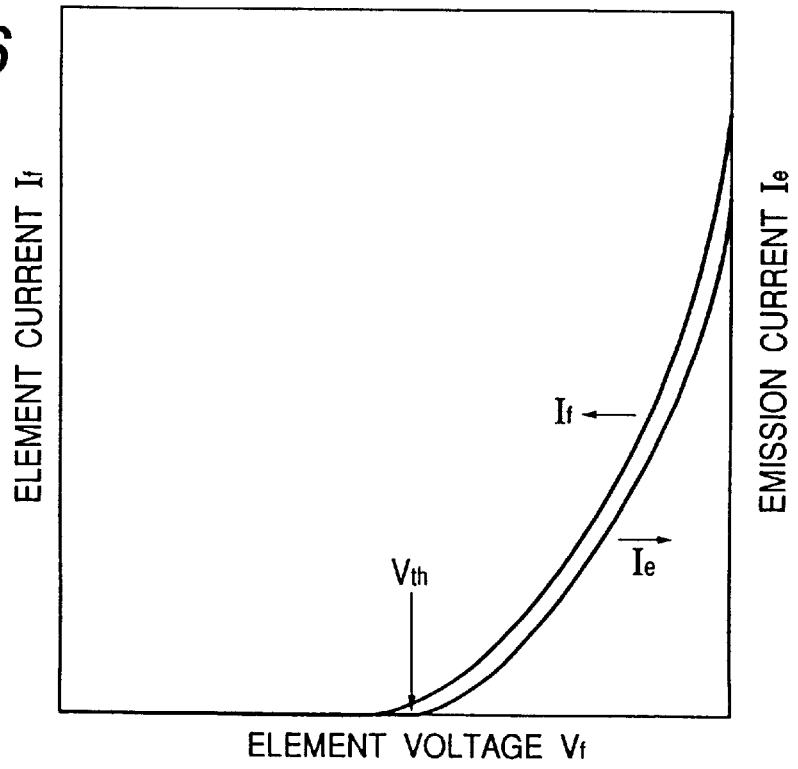
FIG. 6 is a schematic diagram to show electric characteristics of the electron-emitting device of the present invention.

FIG. 6 is a schematic diagram to show the relationship of the emission current $I_e$ and device current $I_f$, measured using the vacuum process apparatus illustrated in FIG. 5, versus the device voltage $V_f$. FIG. 6 is illustrated in arbitrary units, because the emission current $I_e$ is extremely smaller than the device current $I_f$. The abscissa and ordinate both are linear scales.

As also apparent from FIG. 6, the electron-emitting device according to the present invention has three characteristic properties as to the emission current $I_e$.

First, this device increases the emission current $I_e$ suddenly with application of the device voltage not less than a certain voltage (which will be called a threshold voltage; $V_{th}$ in FIG. 6) and the emission current $I_e$ is rarely detected with the device voltage not more than the threshold voltage $V_{th}$. Namely, the device is a nonlinear device having the definite threshold voltage $V_{th}$ against the emission current $I_e$.

Second, because the emission current $I_e$ has monotonically increasing dependence on the device voltage $V_f$, the emission current $I_e$ can be controlled by the device voltage $V_f$.

Third, the emission charge captured by the anode electrode 54 is dependent on the time of application of the device voltage $V_f$. Namely, the charge amount captured by the anode electrode 54 can be controlled by the time of application of the device voltage $V_f$.

As understood from the above description, the electron-emitting device according to the present invention is an electron-emitting device with electron emission characteristics that can be controlled readily according to an input signal. By making use of this property, the electron-emitting device according to the present invention can be applied to equipment in various fields, including an electron source comprised of a plurality of such electron-emitting devices, an image-forming apparatus, and so on.

FIG. 6 shows the example in which the device current $I_f$ monotonically increases against the device voltage $V_f$ (hereinafter referred to as "MI characteristics"), which is indicated by the solid line. It is noted that there are cases in which the device current $I_f$ demonstrates the voltage-controlled negative resistance characteristics (hereinafter referred to as "VCNR characteristics") against the device voltage $V_f$ (though not illustrated). These characteristics can be controlled by controlling the aforementioned steps.

Next, application examples of the electron-emitting device according to the present invention will be described below. An electron source or an image-forming apparatus can be constructed by arraying a plurality of electron-emitting devices according to the present invention on a substrate.

The array configuration of the electron-emitting devices can be selected from a variety of configurations.

An example is a ladder-like configuration in which a lot of electron-emitting devices arranged in parallel are each connected at both ends to wires, many rows of electron-emitting devices are arranged (in a row direction), and electrons from the electron-emitting devices are controlled by control electrodes (which are also referred to as grid electrodes) disposed above the aforementioned electron-emitting devices and along a direction perpendicular to the wires (i.e., in a column direction). Besides, another example is a configuration in which plural electron-emitting devices are arrayed in a matrix pattern along the X-direction and along the Y-direction, first electrodes of the plural electron-emitting devices arranged in each row are connected to a common X-directional wire, and second electrodes of the plural electron-emitting devices arranged in each column are connected to a common Y-directional wire. This configuration is a so-called simple matrix configuration. First, the simple matrix configuration will be detailed below.

The electron-emitting device according to the present invention has the three characteristics described previously. Namely, electrons emitted from the electron-emitting device can be controlled by the peak height and width of the pulsed voltage applied between the opposed device electrodes in the range not less than the threshold voltage. On the other hand, electrons are rarely emitted in the range not more than the threshold voltage. According to this characteristic, in the case of the configuration comprised of many electron-emitting devices, electron emission amounts can also be controlled for selected electron-emitting devices, according to the input signal, by properly applying the pulsed voltage to the individual devices.

Figure 7:
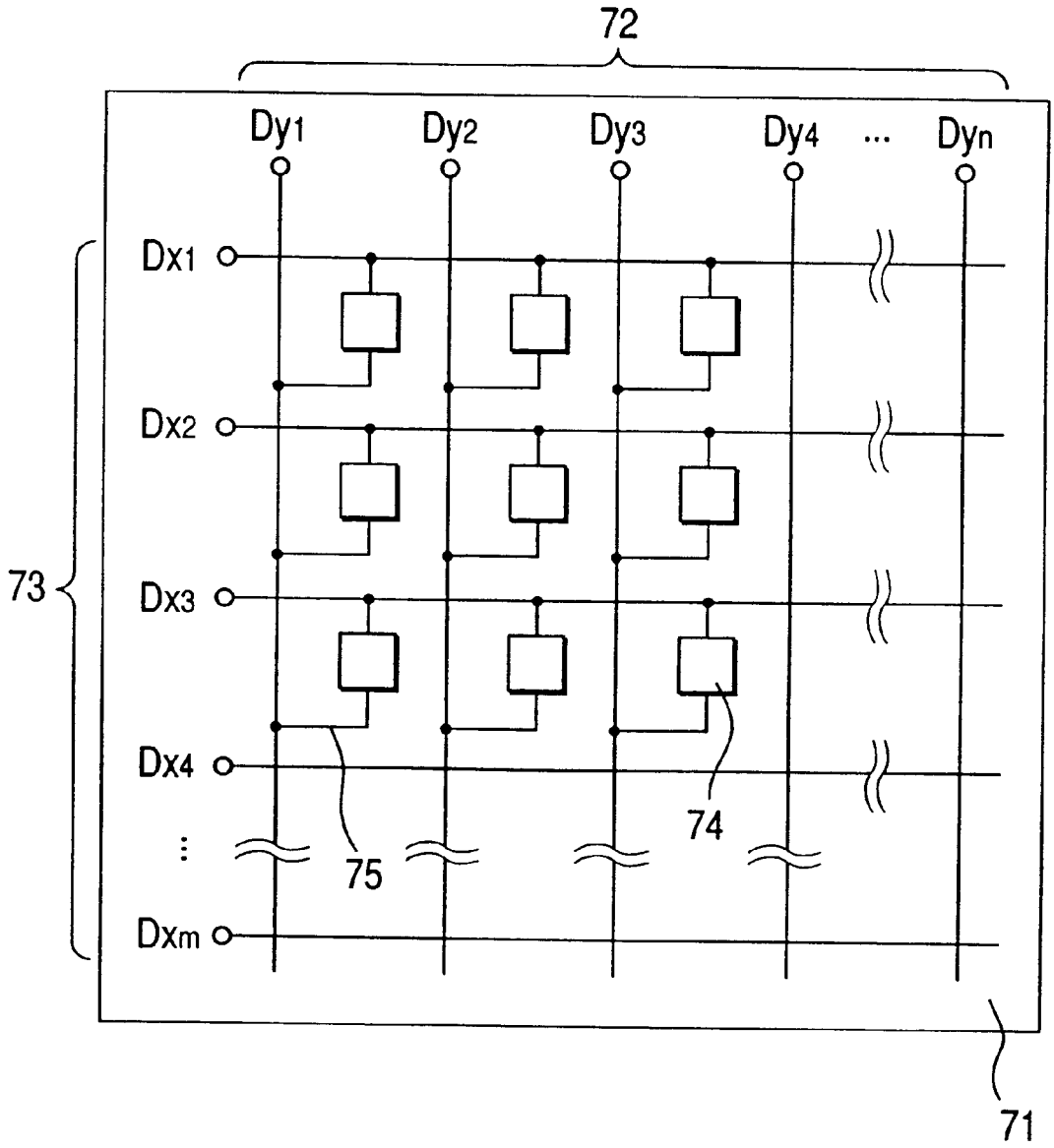
FIG. 7 is a schematic diagram of a configuration in which electron-emitting devices are arrayed in a matrix.

Based on this principle, description will be given referring to FIG. 7 as to an electron source substrate obtained by arraying a plurality of electron-emitting devices according to the present invention. In FIG. 7, there are X-directional wires 73, Y-directional wires 72, electron-emitting devices 74, and connecting wires 75 formed on an electron source substrate 71.

The m X-directional wires 73 are comprised of $D_{x1}$, $D_{x2}$, . . . , $D_{xm}$ and can be constructed of a conductive metal or the like made by vacuum evaporation, printing, sputtering, or the like. The material, thickness, and width of the wires are designed properly as occasion may demand. The Y-directional wires 72 are n wires of $D_{y1}$, $D_{y2}$, . . . , $D_{yn}$ and are made in a similar fashion to the X-directional wires 73. An interlayer insulating layer not illustrated is provided between these m X-directional wires 73 and n Y-directional wires 72, thereby electrically separating them from each other (where m, n are both positive integers).

The interlayer insulating layer not illustrated is made of $SiO_2$ or the like by vacuum evaporation, printing, sputtering, or the like. For example, the thickness, material, and production method of the insulating layer are properly set so that the interlayer insulating layer is formed on the entire surface or in a desired pattern on part of the substrate 71 on which the X-directional wires 73 are formed and, particularly, so that the insulating layer can withstand potential differences at intersecting portions between the X-directional wires 73 and the Y-directional wires 72. The X-directional wires 73 and Y-directional wires 72 are drawn out as external terminals.

Pairs of electrodes (not illustrated) forming the surface conduction electron-emitting devices 74 are each electrically connected to the m X-directional wires 73 and to the n Y-directional wires 72 by the connecting wires 75 of an electroconductive metal or the like.

The material for the wires 72 and the wires 73, the material for the connecting wires 75, and the material for the pairs of device electrodes may share some or all of constituent elements or may be different from each other. These materials are properly selected, for example, from the aforementioned materials for the device electrodes. If the material for the device electrodes is the same as the material for the wires, the wires connected to the device electrodes can be regarded as device electrodes.

Connected to the X-directional wires 73 is an unrepresented scanning signal applying means for applying a scanning signal for selecting a row of surface conduction electron-emitting devices 74 aligned in the X-direction. On the other hand, connected to the Y-directional wires 72 is an unrepresented modulation signal generating means for modulating each column of surface conduction electron-emitting devices 74 aligned in the Y-direction, according to the input signal. A driving voltage applied to each electron-emitting device is supplied as a difference voltage between the scanning signal and the modulation signal applied to the device described previously.

In the above configuration, the individual devices can be selected and driven independently, using the simple matrix wiring.

An example of a method for producing the electron source in the simple matrix configuration described above will be explained referring to FIGS. 20A to 20C and FIGS. 21A to 21C. FIGS. 20A to 20C and FIGS. 21A to 21C show an example for fabricating nine devices for simplicity of explanation.

Figure 20A:
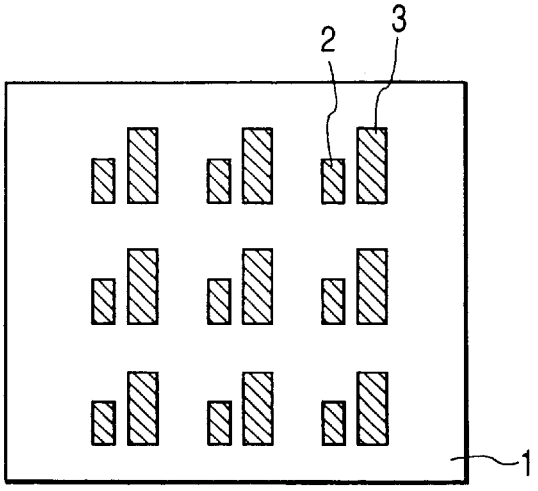
FIG. 20A, FIG. 20B, and FIG. 20C are schematic diagrams to show a process for producing an electron source produced in Example 5.

A plurality of paired device electrodes 2, 3 are formed on a first principal surface of the substrate 1 of sodium-containing glass such as soda lime glass or the like (FIG. 20A). A preferred method for forming the device electrodes is an offset printing method by which the electrodes can be fabricated easily and simply over a large area.

Without having to be limited to the above-stated offset printing method, the device electrodes can also be formed by other forming methods of the device electrodes, of course, including the sputtering method, etc. as described above. When the device electrodes are formed by the offset printing method, an intaglio is filled with ink containing the material for the device electrodes and this ink is transferred onto the substrate 1. The ink thus transferred is heated and baked to form the electrodes.

Figure 20B:
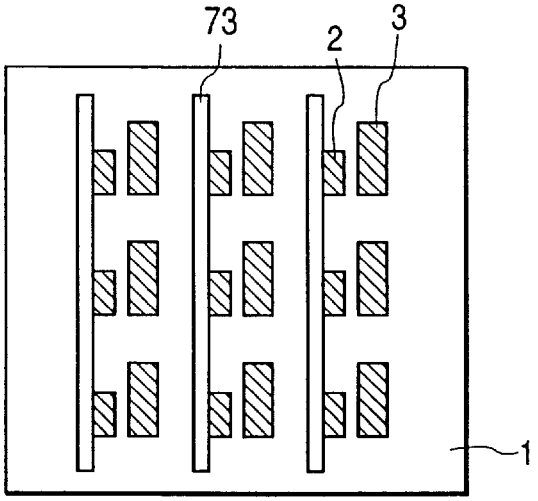

Next, the column-directional wires 73 (X-directional wires or lower wires) are formed so as to be in contact with one-side of the electrodes 2 out of the device electrodes (FIG. 20B). A preferred method for forming the wires 73 is a screen printing method that can form the wires easily and simply over a large area.

Without having to be limited to the above screen printing method, the wires 73 can also be formed by other methods of forming wires 73, of course, including the sputtering method, etc. as described above. When the wires 73 are formed by the screen printing method, a paste containing the material for the wires 73 is printed on the substrate 1 through a screen having apertures in the pattern of the column-directional wires and the paste thus printed is heated and baked to form the wires 73.

Figure 20C:
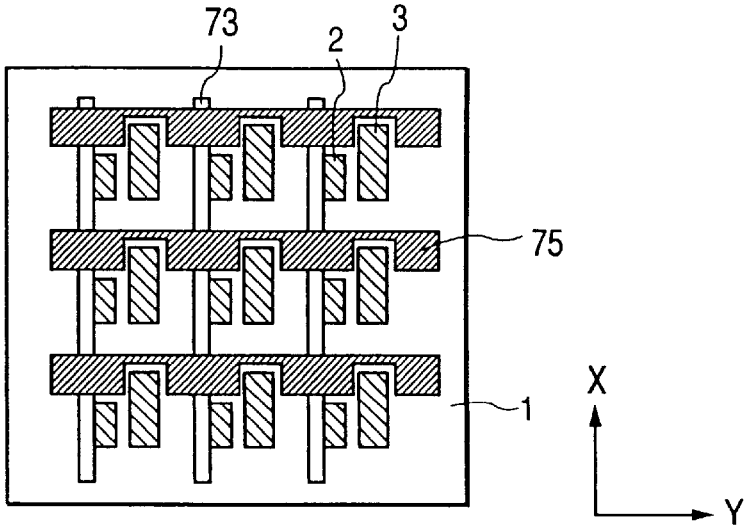

Next, the interlayer insulating layer 75 is formed, at least, at the intersecting portions between the column-directional wires 73 and the row-directional wires 72 (FIG. 20C). A preferred method for forming the interlayer insulating layer 75 is the screen printing method that can form the layer easily and simply over a large area. A preferred pattern of the interlayer insulating layer is such a comb-teeth shape as to cover the intersecting portions between the column-directional wires and the row-directional wires and permit the row-directional wires to be connected to the device electrodes 3, as illustrated in FIG. 20C.

Without having to be limited to the above screen printing method, the interlayer insulating layer 75 can also be formed by other forming methods, of course, including the sputtering method, etc. as described above. When the interlayer insulating layer is formed by the screen printing method, a paste containing an insulating material is printed on the substrate 1 through a screen having apertures in the pattern of the interlayer insulating layer and the paste thus printed is heated and baked to form the interlayer insulating layer 75.

Figure 21A:
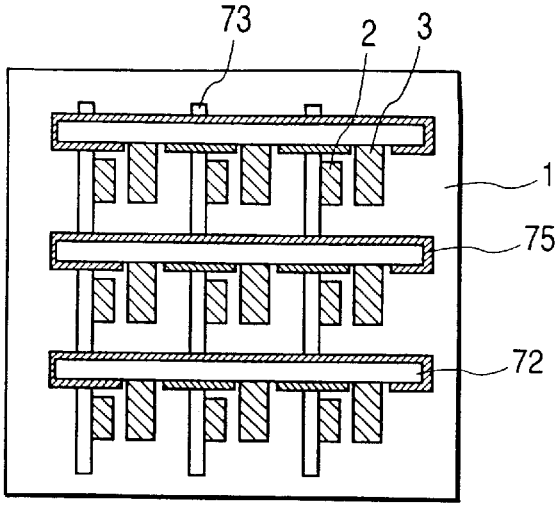
FIG. 21A, FIG. 21B, and FIG. 21C are schematic diagrams to show the process for producing the electron source produced in Example 5.

Then the row-directional wires 72 (Y-directional wires or upper wires) are formed so as to be in contact with one-side of the electrodes 3 out of the device electrodes (FIG. 21A). A preferred method for forming the wires 72 is the screen printing method that can form the wires easily and simply over a large area.

Without having to be limited to the above screen printing method, the wires 72 can also be formed by other forming methods, of course, including the sputtering method, etc. as described above. When the wires 72 are formed by the screen printing method, a paste containing the material for the wires 72 is printed on the substrate 1 through a screen having apertures in the pattern of the row-directional wires and the paste thus printed is heated and baked to form the wires 72.

Figure 21B:
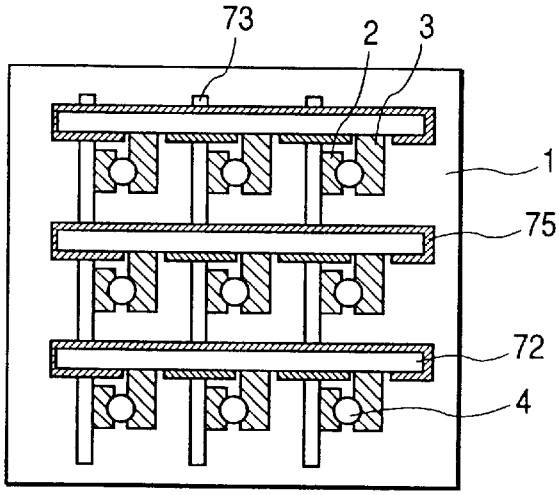

Next, the conductive films 4 are formed so as to effect connection between the device electrodes 2, 3 (FIG. 21B). The electron source substrate before the energization forming step is formed through the above steps. A preferred method for forming the conductive films 4 is an ink jet method that can form the films easily and simply over a large area. Without having to be limited to the above ink jet method, the conductive films 4 can also be formed by other forming methods, of course, including the sputtering method, etc. as described above. When the conductive films 4 are formed by the ink jet method, first, a solution containing the material for forming the conductive films is dispensed to between each pair of device electrodes by the ink jet method. In cases where the material for forming the conductive films is a metal or a metal compound, it is preferable to use a solution containing an organic metal thereof. Then the solution thus dispensed is heated and baked to form the conductive films.

Figure 21C:
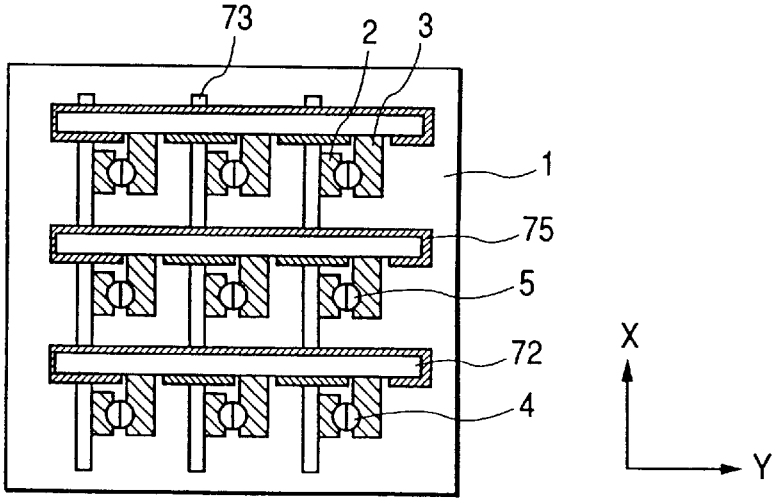
Figure 22A:
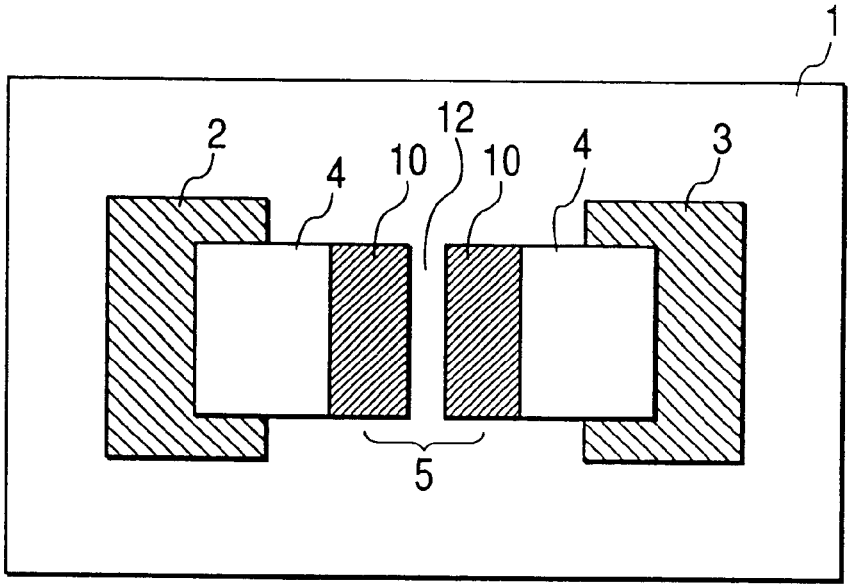
FIG. 22A PRIOR ART
FIG. 22A and FIG. 22B are schematic diagrams of a conventional surface conduction electron-emitting device.
Figure 22B:
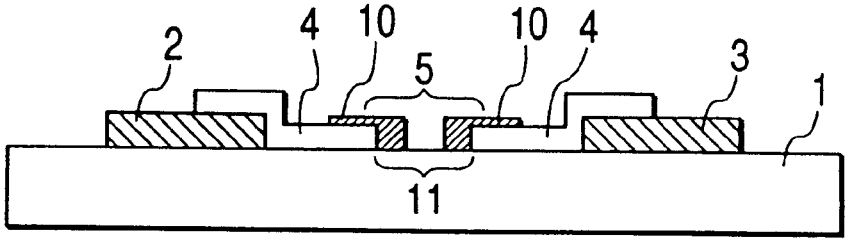
FIG. 22B PRIOR ART

Each of the conductive films is then subjected to the aforementioned energization forming operation and energization activation operation, thereby forming the electron-emitting regions 5. Then the aforementioned stabilization step is carried out, if necessary, to form the electron source (FIG. 21C).

Figure 8:
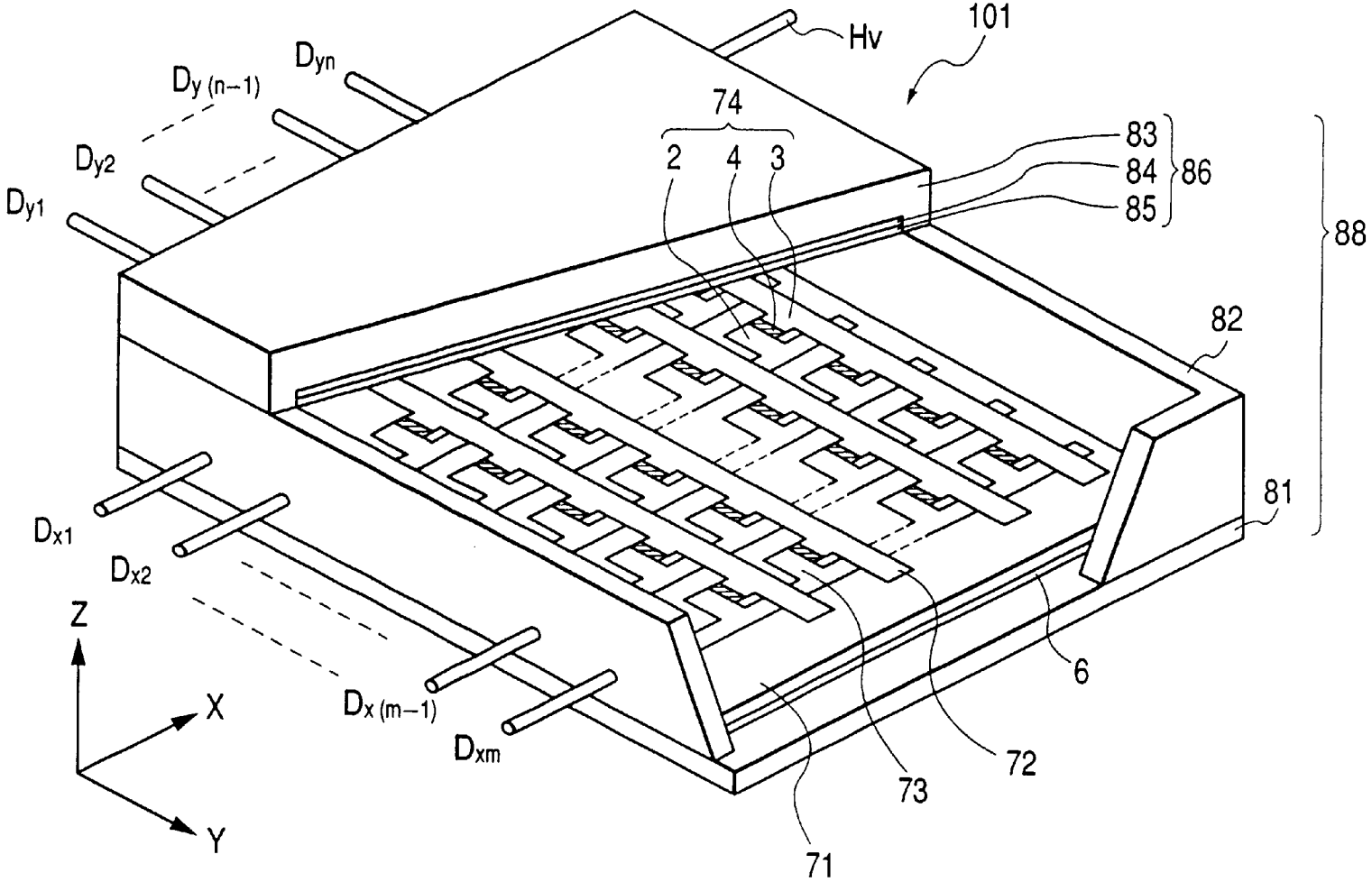
FIG. 8 is a schematic, perspective view of an image-forming apparatus using an electron source with a matrix of electron-emitting devices.
Figure 9A:
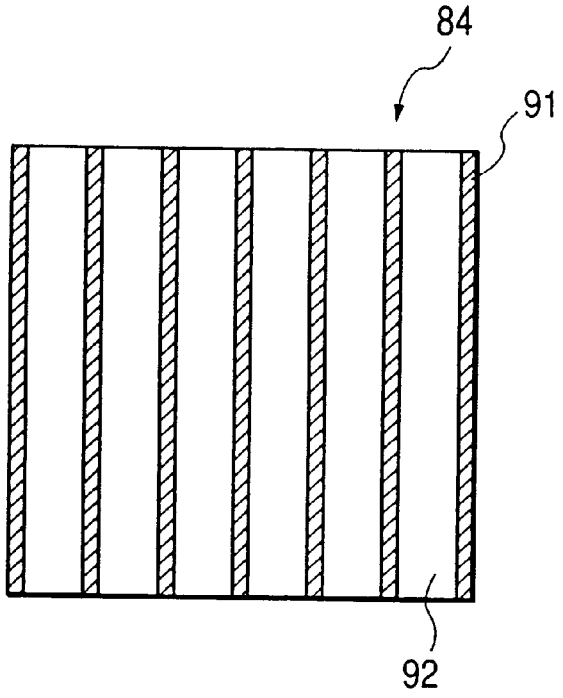
FIGS. 9A and FIG. 9B are schematic diagrams of fluorescent films of the present invention.
Figure 9B:
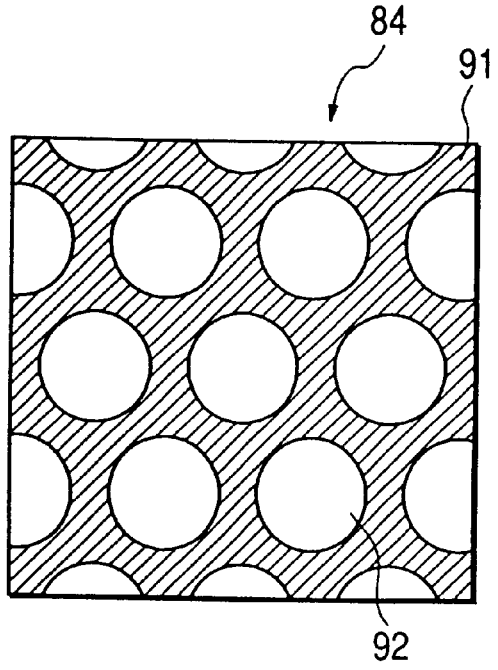
Figure 10:
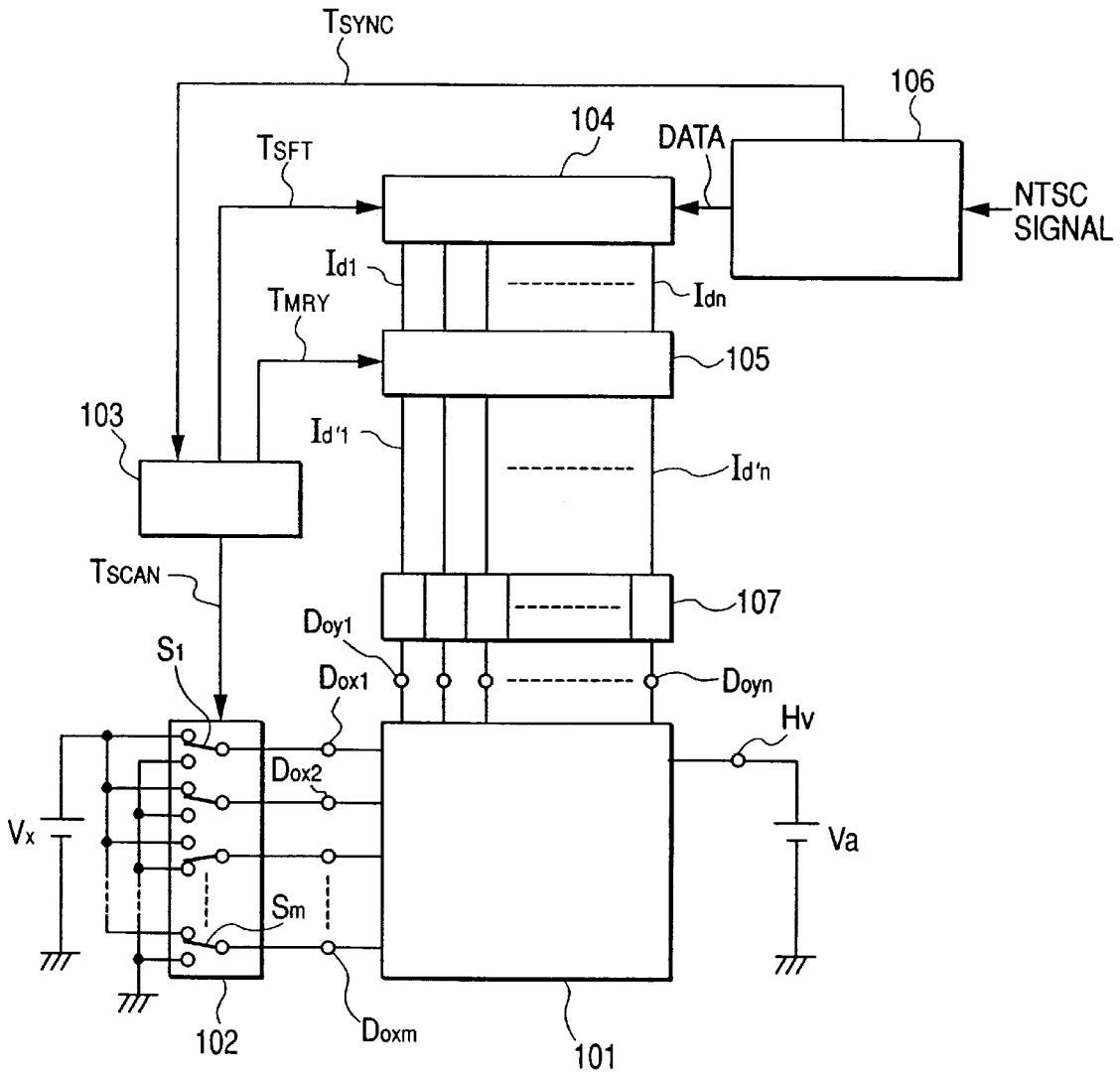
FIG. 10 is a schematic diagram of a circuit configuration for driving the image-forming apparatus of the present invention.

An image-forming apparatus constructed using the electron source of this simple matrix configuration will be described referring to FIG. 8, FIGS. 9A and 9B, and FIG. 10. FIG. 8 is a schematic diagram to show an example of a display panel of the image-forming apparatus, and FIGS. 9A and 9B are schematic diagrams of fluorescent films used in the image-forming apparatus of FIG. 8. FIG. 10 is a block diagram to show an example of driving circuitry for carrying out the display according to TV signals of the NTSC system.

In FIG. 8, the electron source substrate 71 provided with a plurality of electron-emitting devices 74 is fixed to a rear plate 81. A face plate 86 is constructed in such a structure that a fluorescent film 84, a metal back 85, etc. are formed on the inside surface of glass substrate 83. The rear plate 81 and face plate 86 are coupled to the aforementioned support frame 82 with frit glass or the like. An envelope 88 is constructed when it is sealed by baking, for example, in the atmosphere or in nitrogen in the temperature range of 400 to 500° C. for ten minutes or more.

The electron-emitting devices 74 have the structure similar to that of the electron-emitting device illustrated in FIGS. 1A and 1B. A pair of device electrodes 2, 3 in each electron-emitting device are connected to an X-directional wire 72 and to a Y-directional wire 73, respectively.

The envelope 88 is composed of the face plate 86, the support frame 82, and the rear plate 81, as described above. Since the rear plate 81 is provided for the main purpose of reinforcing the strength of the substrate 71, the separate rear plate 81 does not have to be provided if the substrate 71 itself has sufficient strength. In other words, the envelope 88 may also be composed of the face plate 86, the support frame 82, and the substrate 71 by direct sealing of the support frame 82 to the substrate 71. In the case of the structure of FIG. 8, the back electrode 6 is provided on the back surface of the substrate 71. On the other hand, it is also possible to construct the envelope 88 with sufficient strength against the atmospheric pressure by interposing an unrepresented support called a spacer between the face plate 86 and the rear plate 81.

FIG. 9A and FIG. 9B are schematic diagrams to show fluorescent films. The fluorescent film 84 can be made of only a fluorescent material in the monochrome case. In the case of the color fluorescent film, the fluorescent film can be made of a black member 91, called black stripes or a black matrix or the like, and fluorescent materials 92. The black stripes can be made of a material containing graphite as a matrix, or can also be made of any electroconductive material with little transmission and reflection of light.

The face plate 86 may also be provided with a transparent electrode (not illustrated) placed between the fluorescent film 84 and the face plate 86 in order to enhance the electrically conductive property of the fluorescent film 84 further.

The image-forming apparatus illustrated in FIG. 8 is produced, for example, as follows.

Here is an example in which the electron source substrate also serves as a rear plate.

First prepared is the electron source substrate before the energization forming, which was explained in the method for forming the aforementioned electron source.

Then frit glass is deposited on the joint part between the support frame 82 and the electron source substrate. At the same time, the frit glass is also placed on the joint part between the support frame 82 and the face plate 86 on which the fluorescent film 84 and metal back 85 are formed. If a spacer is placed between the face plate and the electron source substrate, the spacer is preliminarily bonded and fixed with frit glass on the upper wires of the electron source substrate.

Then the support frame 82 is mounted on the portion where the frit was placed on the electron source substrate, and the face plate is further mounted so that the frit glass preliminarily deposited on the face plate is overlaid on the support frame 82.

Then they are heated while the face plate and the electron source substrate are pressed, if necessary, so as to effect the sealing, thus forming the envelope 88.

While being heated, if necessary, similar to the aforementioned stabilization step, the envelope 88 is evacuated through an unrepresented exhaust pipe by an exhaust device not using oil, such as the ion pump, the absorption pump, or the like, down to the atmosphere containing little organic substance in the degree of vacuum of about $10^{-7}$ Torr, and the sealing is then effected. A getter operation can also be performed in order to maintain the degree of vacuum after the sealing of the envelope 88. This is an operation for heating a getter placed at a predetermined position (not illustrated) inside the envelope 88 by heating using resistance heating, high-frequency heating, or the like immediately before execution of the sealing of the envelope 88 or after the sealing thereof to form an evaporated film. The getter is normally one containing the principal component of Ba or the like, which maintains, for example, the degree of vacuum of $1\times10^{-5}$ to $1\times10^{-7}$ Torr by adsorption of the evaporated film. Here, the steps of the forming operation and after of the electron-emitting devices can be set as occasion may demand.

Next described referring to FIG. 10 is a structural example of the driving circuitry for carrying out the television display based on TV signals of the NTSC system on the display panel constructed using the electron source of the simple matrix configuration. In FIG. 10, there are a scanning circuit 102, a control circuit 103, a shift register 104, a line memory 105, a synchronous signal separating circuit 106, a modulation signal generator 107, and dc voltage supplies $V_x$ and $V_a$ provided for driving an image display panel 101.

The display panel 101 is connected to the external circuits via the terminals $D_{ox1}$ to $D_{oxm}$, the terminals $D_{oy1}$ to $D_{oyn}$, and high-voltage terminal Hv. Applied to the terminals $D_{ox1}$ to $D_{oxm}$ are scanning signals for successively driving the electron source disposed in the display panel, i.e., the group of electron-emitting devices arranged in the matrix wiring pattern of m rows×n columns, row by row (every n devices).

Applied to the terminals $D_{y1}$ to $D_{yn}$ are modulation signals for controlling output electron beams from the respective electron-emitting devices in one row selected by the scanning signal. Supplied to the high-voltage terminal Hv is the dc voltage, for example, of 10 kV from the dc voltage supply $V_a$, which is an accelerating voltage for imparting sufficient energy for excitation of the fluorescent material to the electron beams emitted from the electron-emitting devices.

The scanning circuit 102 will be described. This circuit includes m switching devices (schematically indicated by $S_1$ to $S_m$ in the drawing) inside. Each switching device selects either the output voltage of the dc voltage supply $V_x$ or 0 V (the ground level) to be electrically connected to the terminal $D_{x1}$ to $D_{xm}$ of the display panel 101. Each switching device $S_1$ to $S_m$ operates based on a control signal $T_{scan}$ outputted from the control circuit 103 and can be constructed, for example, of a combination of switching devices such as FETs.

In the case of this example, the dc voltage supply $V_x$ is set to output such a constant voltage that the driving voltage applied to the devices not scanned is not more than the electron emission threshold voltage, based on the characteristic (electron emission threshold voltage) of the electron-emitting device.

The control circuit 103 has the function to match operations of the respective sections with each other so as to carry out the appropriate display based on the image signals supplied from the outside. The control circuit 103 generates control signals of $T_{scan}$, $T_{sft}$, and $T_{mry}$ to the respective sections, based on a synchronous signal $T_{sync}$ sent from the synchronous signal separating circuit 106.

The synchronous signal separating circuit 106 is a circuit for separating a synchronous signal component and a luminance signal component from the TV signal of the NTSC system supplied from the outside, which can be constructed of an ordinary frequency separation (filter) circuit or the like. The synchronous signal separated by the synchronous signal separating circuit 106 is comprised of a vertical synchronous signal and a horizontal synchronous signal, which are illustrated as a $T_{sync}$ signal for convenience of explanation. The luminance signal component of image separated from the TV signal is represented by a DATA signal for convenience of explanation. This DATA signal is inputted into the shift register 104.

The shift register 104 is provided for effecting serial/parallel conversion for every line of image with the DATA signal serially inputted in time series and operates based on the control signal $T_{sft}$ sent from the control circuit 103. (In other words, the control signal $T_{sft}$ can also be mentioned as a shift clock of the shift register 104.) Data of one line of image after the serial/parallel conversion (corresponding to driving data for N electron-emitting devices) is outputted as N parallel signals of $I_{d1}$ to $I_{dn}$ from the shift register 104.

The line memory 105 is a storage device for storing the data of one line of image for a required period and properly stores the contents of $I_{d1}$ to $I_{dn}$ according to the control signal $T_{mry}$ sent from the control circuit 103. The contents stored are outputted as $I'_{d1}$ to $I'_{dn}$ to be supplied to the modulation signal generator 107.

The modulation signal generator 107 is a signal source for properly driving and modulating each of the electron-emitting devices according to each of the image data I'd1to $I'_{dn}$ and output signals therefrom are applied via the terminals $D_{oy1}$ to $D_{oyn}$ to the electron-emitting devices in the display panel 101.

As described previously, the electron-emitting devices according to the present invention have the following basic characteristics as to the emission current $I_e$. Namely, the devices have the definite threshold voltage $V_{th}$ for emission of electrons, so that emission of electrons occurs only when the voltage not less than $V_{th}$ is applied. For voltages not less than the electron emission threshold, the emission current also varies according to a change of the voltage applied to each device. From this feature, where the pulsed voltage is applied to the device, emission of electron does not take place, for example, with application of a voltage not more than the electron emission threshold voltage, but an electron beam is outputted with application of a voltage not less than the electron emission threshold voltage. On that occasion, the intensity of the output electron beam can be controlled by changing the peak height $V_m$ of the pulse. The total amount of charge of the output electron beam can be controlled by changing the width $P_w$ of the pulse.

Therefore, a voltage modulation method, a pulse duration modulation method, and so on can be employed as a method for modulating the electron-emitting devices according to the input signal. For carrying out the voltage modulation method, the modulation signal generator 107 can be a circuit of the voltage modulation method capable of generating voltage pulses of a constant length and properly modulating peak heights of the pulses according to the input data.

For carrying out the pulse duration modulation method, the modulation signal generator 107 can be a circuit of the pulse duration modulation method capable of generating voltage pulses with a constant peak height and properly modulating the widths of the voltage pulses according to the input data.

The shift register 104 and the line memory 105 can be of either a digital signal type or an analog signal type. This is because one point necessary is that the serial/parallel conversion and storage of image signals are carried out at predetermined speed.

In the case of the digital signal type, the output signal DATA of the synchronous signal separating circuit 106 needs to be digitized and this is implemented by an A/D converter (not shown) disposed at an output portion of the synchronous signal separating circuit 106. In connection therewith, the circuit used in the modulation signal generator 107 differs slightly, depending upon whether the output signals of the line memory 105 are digital signals or analog signals. Namely, in the case of the voltage modulation method using digital signals, the modulation signal generator 107 is, for example, a D/A converter and an amplifier or the like is added thereto if necessary. In the case of the pulse duration modulation method, the modulation signal generator 107 is a circuit, for example, obtained by combining a high-speed oscillator and a counter for counting the number of waves output from the oscillator with a comparator for comparing an output value from the counter with an output value from the memory. An amplifier can also be added for voltage-amplifying the modulation signal modified in pulse duration, output from the comparator, up to the driving voltage of the electron-emitting device, if necessary.

In the case of the voltage modulation method using analog signals, the modulation signal generator 107 can be, for example, an amplifier using an operational amplifier or the like and a level shift circuit or the like can also be added thereto if necessary. In the case of the pulse duration modulation method, for example, a voltage-controlled oscillator (VCO) can be employed and an amplifier can also be added thereto for voltage-amplifying the modulation signal up to the driving voltage of the electron-emitting device, if necessary.

In the image-forming apparatus (display apparatus) of the present invention as described above, electron emission occurs when the signal voltage and scanning voltage are applied to each electron-emitting device via the external terminals $D_{ox1}$ to $D_{oxm}$, $D_{oy1}$ to $D_{oyn}$ outside the vessel. The high voltage is applied via the high-voltage terminal Hv to the metal back 85 or to a transparent electrode (not illustrated), thereby accelerating the electron beams. The fluorescent film 84 is bombarded with the electrons thus accelerated to bring about luminescence, thereby forming an image.

The structure of the image-forming apparatus described herein is just an example of an image-forming apparatus according to the present invention and a variety of modifications can be made based on the technical concept of the present invention. The input signals were of the NTSC system, but the input signals are not limited to this system. For example, they can be signals of the PAL system, the SECAM system, or the like, or signals of systems of TV signals comprised of more scanning lines than the foregoing systems (for example, high-definition TV systems including the MUSE system, and the ATV system).

Next, an electron source of the ladder-type configuration and an image-forming apparatus will be described referring to FIG. 11 and FIG. 12.

Figure 11:
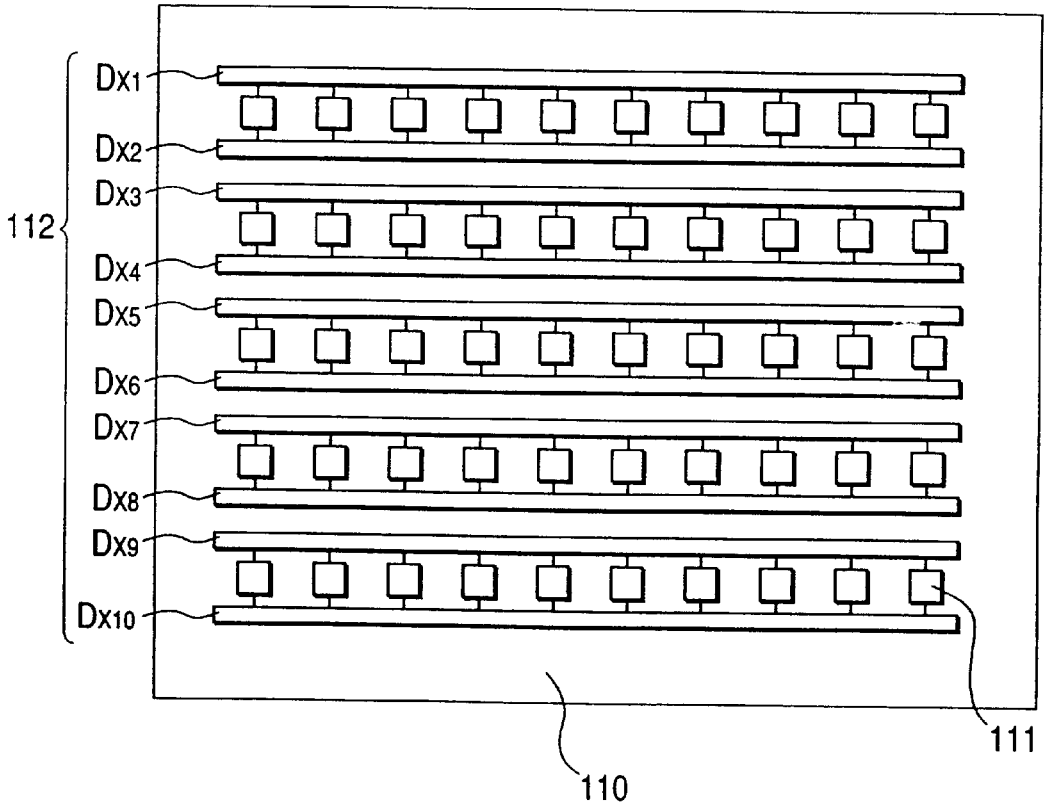
FIG. 11 is a schematic diagram of a configuration in which electron-emitting devices of the present invention are arrayed in a ladder pattern.

FIG. 11 is a schematic diagram to show an example of the electron source of the ladder-type configuration. In FIG. 11, electron-emitting devices 111 are formed on an electron source substrate 110. Common wires 112 ($D_{x1}$ to $D_{x10}$) are provided for connection of the electron-emitting devices 111. The electron-emitting devices 111 are arranged in parallel rows along the X-direction (which will be called device rows) on the substrate 110. The electron source is composed of a plurality of such device rows. Each device row can be driven independently by placing the driving voltage between the common wires of each device row. Namely, the voltage not less than the electron emission threshold is applied to a device row expected to emit electron beams, whereas the voltage not more than the electron emission threshold is applied to a device row expected not to emit electron beams. The common wires $D_{x2}$ to $D_{x9}$ between the device rows can also be formed as single wires; for example, $D_{x2}$ and $D_{x3}$ can be made as a single wire.

Figure 12:
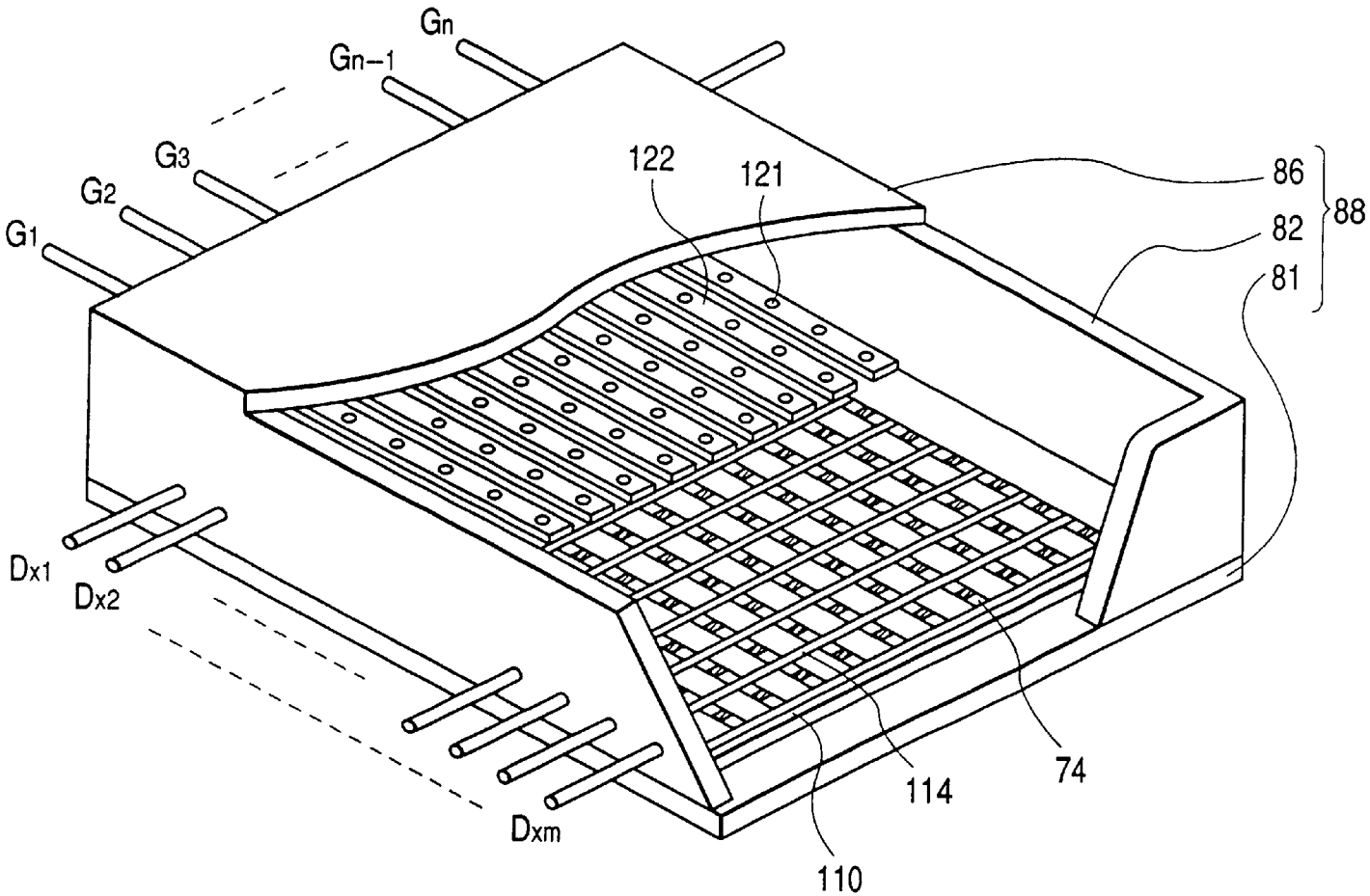
FIG. 12 is a schematic, perspective view of an image-forming apparatus using an electron source with a ladder pattern of electron-emitting devices.

FIG. 12 is a schematic diagram to show an example of the panel structure in an image-forming apparatus provided with the electron source of the ladder-type configuration. Grid electrodes 122 are provided with pores 121 for electrons to pass through. $D_{x1}$, $D_{x2}$, . . . , $D_{xm}$ denote outside terminals. $G_1$, $G_2$, . . . , $G_n$ denote outside terminals connected to the grid electrodes 122. In an electron source substrate 110 the common wires between the device rows are made in the form of integral wires. In FIG. 12, the same portions as those illustrated in FIG. 8 and FIG. 11 are denoted by the same reference symbols in those drawings. The image-forming apparatus shown herein is mainly different from the image-forming apparatus of the simple matrix configuration illustrated in FIG. 8 in that the image-forming apparatus herein is provided with the grid electrodes 122 between the electron source substrate 110 and the face plate 86.

In FIG. 12, the grid electrodes 122 are provided between the substrate 110 and the face plate 86. The grid electrodes 122 are provided for the purpose of modulating the electron beams emitted from the surface conduction electron-emitting devices and are provided with circular pores 121 for each device in order to let the electron beams pass the stripe-shape electrodes perpendicular to the device rows of the ladder-shape configuration. The shape and arrangement of the grid electrodes are not limited to those illustrated in FIG. 12. For example, the pores can be a lot of pass holes in a mesh pattern and the grid electrodes can be located around or near the surface conduction electron-emitting devices.

The outside terminals $D_{x1}$, $D_{x2}$, . . . , $D_{xm}$ and grid terminals $G_1$, $G_2$, . . . , $G_n$ are electrically connected to the control circuit (not illustrated).

In the image-forming apparatus of the present example, modulation signals for one line of image are applied simultaneously to the grid electrode array in synchronism with successive driving (scanning) of the device rows row by row. This permits the image to be displayed line by line by controlling irradiation of each electron beam onto the fluorescent material.

The image-forming apparatus of the present invention can be used as an image-forming apparatus (a display device) for television broadcasting or an image-forming apparatus (a display device) for a video conference system, a computer, or the like and in addition, it can also be used as an image-forming apparatus or the like as an optical printer constructed using a photosensitive drum or the like.

EXAMPLES

The present invention will be described in detail with examples thereof, but it is noted that the present invention is by no means intended to be limited to these examples and the present invention also embraces structures and arrangements after replacement or design change of each element within the scope in which the object of the present invention is accomplished.

Example 1

The basic structure of the electron-emitting device according to the present invention is similar to that in the plan view and sectional view of FIGS. 1A and 1B. The production process of the electron-emitting device according to the present invention is basically similar to that in FIGS. 3A to 3D. The basic structure and production process of the device according to the present invention will be described referring to FIGS. 1A and 1B and FIGS. 3A to 3D.

In FIGS. 1A and 1B, there are the device electrodes 2, 3, the electron-emitting region 5, and the electroconductive film 4 provided on the substrate 1 and the back electrode 6 on the back surface of the substrate 1.

The production process of the device will be described in order, based on FIGS. 1A and 1B and FIGS. 3A to 3D.

(Step a)

On the substrate 1, which was obtained by forming a silicon oxide film 0.5 $\mu$m thick on a cleaned soda lime glass plate by sputtering, a pattern expected to become the device electrodes 2, 3 and the gap between the device electrodes was formed with a photoresist and then Ti and Ni were successively deposited in the thickness of 50 angstroms and in the thickness of 1000 angstroms, respectively, in the stated order by vacuum evaporation. Then the photoresist pattern was dissolved with an organic solvent, and the Ni/Ti deposited films were lifted off, thereby forming the device electrodes 2, 3 having the device electrode gap L1 of 10 $\mu$m and the device electrode width W of 300 $\mu$m. Further, Pt was deposited in the thickness of 1000 angstroms on the back surface, thereby forming the back electrode 6 (FIG. 3A).

(Step b)

Using a mask with pores at and near the gap between the device electrodes, a Cr film having the thickness of 1000 angstroms was deposited by vacuum evaporation and patterned, and then organic Pd was spin-coated thereon with a spinner. The heating and baking operation was carried out at 300° C. for ten minutes. The conductive film 4 containing the principal element of Pd thus formed had the thickness of 100 angstroms and the sheet resistance of $2\times10^4$ Ω/□.

The Cr film and the conductive film 4 after baking were etched with an acid etchant to form a desired pattern.

The device electrodes 2, 3 and the conductive film 4 were formed on the substrate 1 through the above steps (FIG. 3B).

(Step c) Application of an electric field to the substrate

Then a positive voltage with respect to the back electrode 6 was applied to the device electrodes 2, 3 as illustrated in FIG. 3C. The thickness of the substrate was 2.8 mm, the voltage applied was 1 kV, and the time of application was 2 hours. The current density of the current flowing at this time was $7.1\times10^{-10}$ A/cm$^2$ and the charge moved in one hour was $4.8\times10^{-6}$ C. Most of the carriers for electric conduction in the soda lime glass were Na ions, so that this step c caused the Na ions to move from the front surface of the substrate toward the back surface of the substrate. Therefore, the concentration of Na ions near the front surface decreased remarkably.

(Step d) Forming

Then the substrate was set in the measurement/evaluation device of FIG. 5 and the inside thereof was evacuated by a vacuum pump. After arrival at the vacuum degree of $2\times10^{-6}$ Torr, the voltage was placed between the device electrodes 2, 3 from the power supply 51 for applying the device voltage Vf to the device, thereby effecting the energization operation (forming operation). The voltage waveforms in the forming operation are illustrated in FIG. 24. In FIG. 24, T1 and T2 represent the pulse width and the pulse interval of the voltage waveforms, respectively. In the present example the forming operation was carried out under such conditions that T1 was 1 msec, T2 was 10 msec, and the peak heights of rectangular waves (the peak voltages during the forming) were increased by steps of 0.1 V. During the forming operation, at the same time, resistance-measuring pulses were placed in the voltage of 0.1 V during the intervals T2 to measure the resistance. It was assumed that the end of the forming operation was at the time when the measurement with the resistance-measuring pulse became about 1 MΩ or more. At that timing the application of the voltage to the device was stopped. The forming voltage V of the device was 5.1 V.

Subsequently, the device after the forming operation was subjected to the energization activation operation. The application of the voltage pulses was carried out under such conditions that the peak heights of rectangular waves in the waveforms of FIG. 25 were 14 V, the pulse width was 100 $\mu$s, and the repetition frequency was 10 Hz, thereby forming the electron-emitting region 5 (FIG. 3D). The measurement of the electron emission characteristics of the device produced according to the above steps was carried out using the measurement/evaluation device of FIG. 5.

The measurement was carried out under such conditions that the distance between the anode electrode and the electron-emitting device was 4 mm, the potential of the anode electrode was 1 kV, and the degree of vacuum in the vacuum device during the measurement of electron emission characteristics was $1\times10^{-6}$ Torr.

Using the measurement/evaluation device as described above, the voltage was applied as a device voltage between the electrodes 2 and 3 of the present device and the device current If and emission current le flowing at that time were measured. The result obtained was the current-voltage characteristics as illustrated in FIG. 6. Since the amount of Na ions in the front surface of the substrate was decreased and became smaller than before, the steps of the forming and after became stable and the yield was improved thereby. Further, variations were decreased in the characteristics among devices. Particularly, where a plurality of electron-emitting devices were formed on a single substrate, the uniformity of electron emission characteristics was improved greatly.

In the example described above, the forming operation was carried out by applying the rectangular pulses between the electrodes of the device during the formation of the electron-emitting region and the activation was carried out by applying the rectangular pulses; however, without having to be limited to the above waveforms, the waveforms applied between the electrodes of the device can also be any desired waveforms selected from rectangular waves, triangular waves, trapezoid waves, sinusoidal waves, and so on. In addition, the peak heights, the pulse width, the pulse interval, etc. do not always have to be limited to the aforementioned values, either, and desired values can be selected therefor in the scope of the present invention as long as the electron-emitting region is formed in good order.

Example 2

The second example will be described as an example in which the substrate is heated during the application of voltage.

Figure 2A:
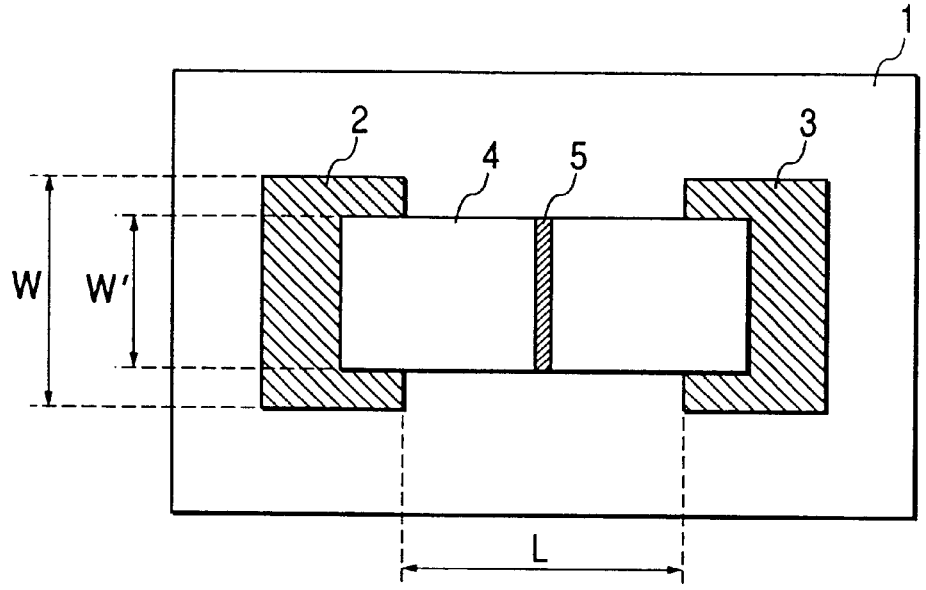
FIG. 2A and FIG. 2B are schematic diagrams of an electron-emitting device produced in Example 2.
Figure 2B:
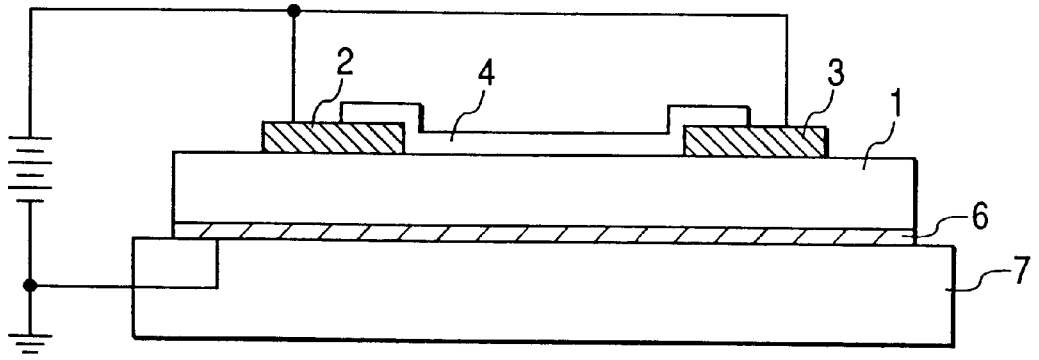

In FIGS. 2A and 2B, there are the device electrodes 2, 3, the conductive film 4, and the electron-emitting region 5 provided on the substrate 1. Further, the back electrode 6 is provided on the back surface of the substrate 1. The substrate 1 is heated with a heater 7 for heating of the substrate. The steps up to step b before the application of the electric field to the substrate were similar to those in Example 1. The steps of the application of the electric field and after will be described in order below.

(Step c') Heating of the substrate and application of the electric field

Figure 18:
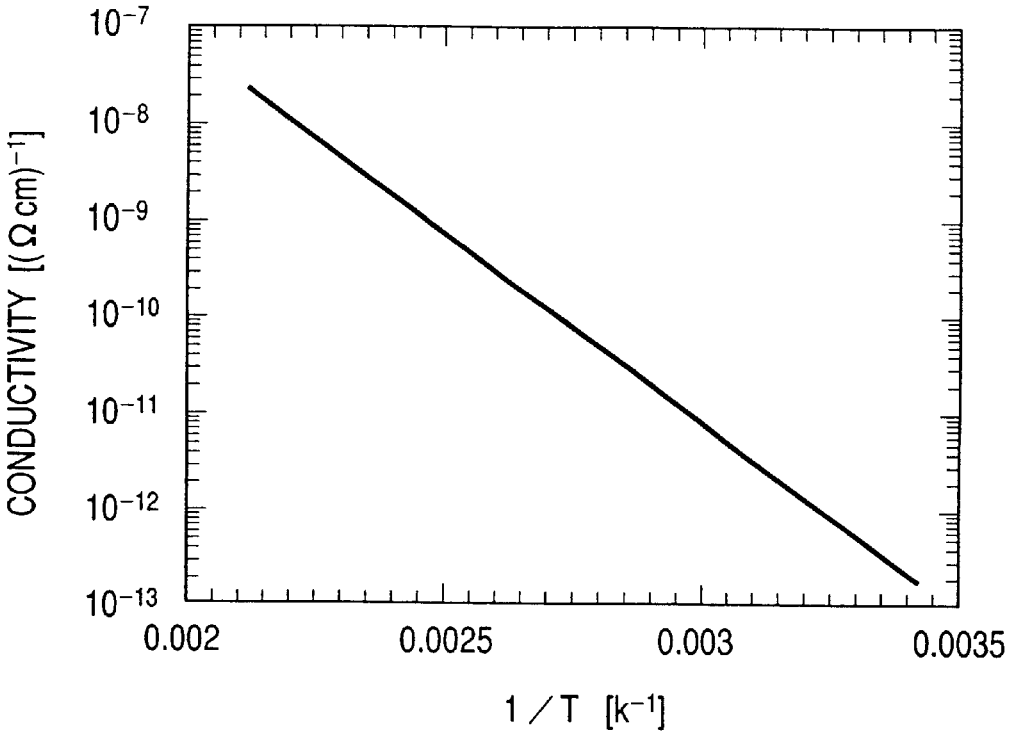
FIG. 18 is a schematic diagram to show temperature dependence of electric conductivity of a substrate containing sodium.
Figure 19:
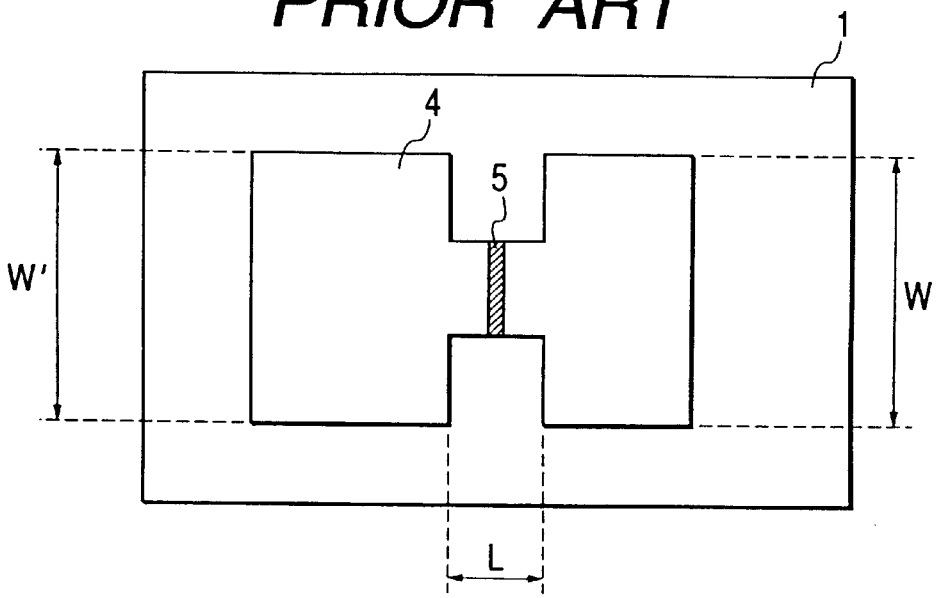
FIG. 19 PRIOR ART
FIG. 19 is a schematic diagram of a conventional surface conduction electron-emitting device.

After the formation of the electrodes 2, 3, 6 and the conductive film 4, the substrate 1 was mounted on the heater 7 and was heated to 60° C. by the heater 7. After the temperature of the substrate was elevated, the voltage was applied as in Example 1 (FIG. 2B). FIG. 18 shows the relation between electric conductivity and temperature of soda lime glass. There is the following relation between electric conductivity σ and temperature T.

$$\sigma=a\times exp(-b/T)$$

b: activation energy

Therefore, the time of application of the voltage can be varied by changing the temperature. Supposing the voltage application time is t1 at the temperature T1, the voltage application time t2 at the temperature T2 can be defined by the following equation.

$$t2=t1\times\exp(b\times(1/T2-1/T1)$$

Accordingly, in order to move the same amount of Na ions as at room temperature, the time at 60° C. can be decreased by the magnitude of about one order. In the case of the present example, while the back surface of the substrate was kept at the ground, the voltage of 1 kV was applied for ten minutes to the front surface of the substrate. The heating enabled more reduction of time than in Example 1. Since the electric conductivity varies with the heating of the substrate as described above, the voltage and application time can be adjusted by changing the temperature for heating the substrate.

(Step d') Forming

Then the substrate was set in the measurement/evaluation device of FIG. 5 and the inside thereof was evacuated by a vacuum pump. After arrival at the vacuum degree of $2\times10^{-6}$ Torr, the voltage was placed between the device electrodes 2, 3 from the power supply 51 for applying the device voltage Vf to the device, thereby effecting the energization operation (forming operation). The voltage waveforms in the forming operation are illustrated in FIG. 24. In FIG. 24, T1 and T2 represent the pulse width and the pulse interval of the voltage waveforms, respectively. In the present example the forming operation was carried out under such conditions that T1 was 1 msec, T2 was 10 msec, and the peak heights of the rectangular waves (the peak voltages during the forming) were increased by steps of 0.1 V. During the forming operation, at the same time, resistance-measuring pulses were placed in the voltage of 0.1 V during the intervals T2 to measure the resistance. It was assumed that the end of the forming operation was at the time when the measurement with the resistance-measuring pulse became about 1 MΩ or more. At that timing the application of the voltage to the device was stopped. The forming voltage V of the device was 5.0 V.

Subsequently, the device after the forming operation was subjected to the energization activation operation. The application of the voltage pulses was carried out under such conditions that the peak heights of the rectangular waves in the waveforms of FIG. 25 were 14 V, the pulse width was 100 μs, and the repetition frequency was 10 Hz, thereby forming the electron-emitting region 5. The measurement of the electron emission characteristics of the device produced according to the above steps was carried out using the measurement/evaluation device of FIG. 5.

The measurement was carried out under such conditions that the distance between the anode electrode and the electron-emitting device was 4 mm, the potential of the anode electrode was 1 kV, and the degree of vacuum in the vacuum device during the measurement of electron emission characteristics was $1\times 10^{-6}$ Torr.

Using the measurement/evaluation device as described above, the voltage was applied as a device voltage between the electrodes 2 and 3 of the present device and the device current $I_f$ and emission current $I_e$ flowing at that time were measured. The result obtained was the current-voltage characteristics as illustrated in FIG. 6. Since the amount of Na ions in the front surface of the substrate was decreased and became smaller than before, the steps of the forming and after became stable and the yield was improved thereby. Further, variations were decreased in the characteristics among devices. Particularly, where a plurality of electron-emitting devices were formed on a single substrate, the uniformity of electron emission characteristics was improved greatly. Further, the voltage application time was reduced remarkably, as compared with that in Example 1.

In the example described above, the forming operation was carried out by applying the rectangular pulses between the electrodes of the device during the formation of the electron-emitting region and the activation was carried out by applying the rectangular pulses; however, without having to be limited to the above waveforms, the waveforms applied between the electrodes of the device can also be any desired waveforms selected from rectangular waves, triangular waves, trapezoid waves, sinusoidal waves, and so on. In addition, the peak heights, the pulse width, the pulse interval, etc. do not always have to be limited to the aforementioned values, either, and desired values can be selected therefor in the scope of the present invention as long as the electron-emitting region is formed in good order.

Example 3

The present example is an example of the image-forming apparatus having a lot of electron-emitting devices arrayed in the simple matrix configuration.

Figure 13:
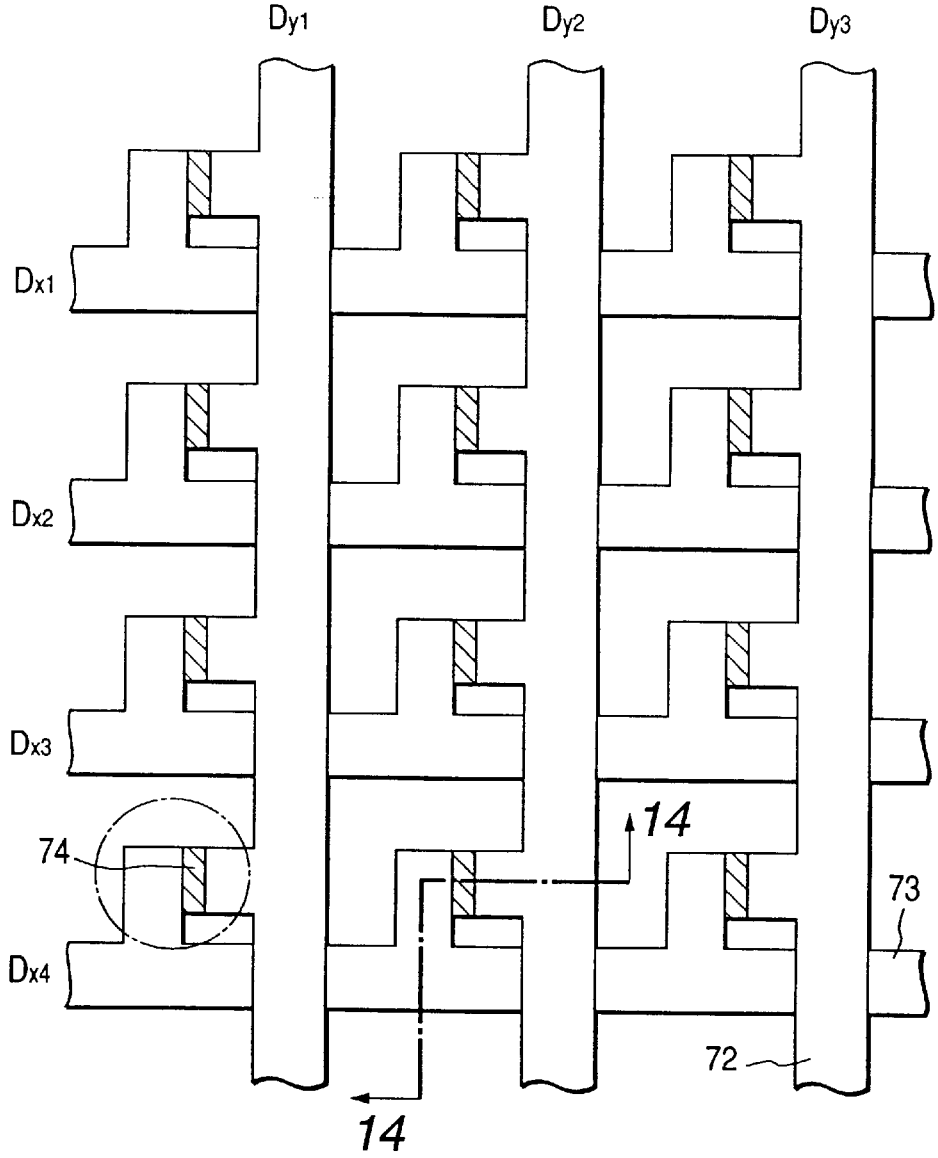
FIG. 13 is a schematic diagram of an electron source in which the electron-emitting devices are arrayed in a matrix.
Figure 14:
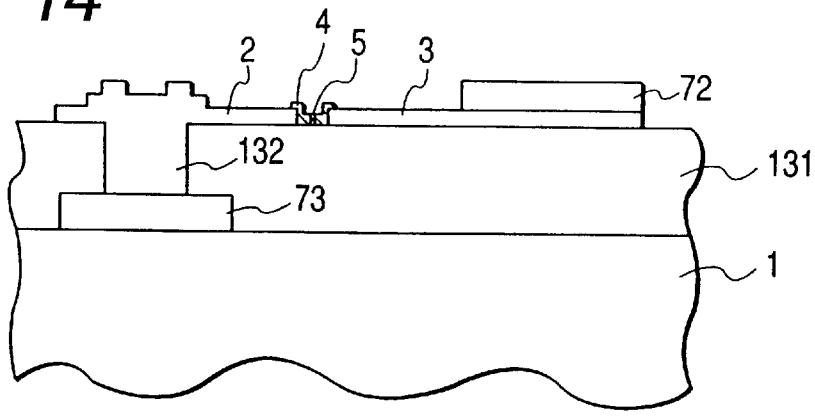
FIG. 14 is a partial, sectional, schematic diagram of an electron source produced in Example 3.

A plan view of part of the electron source is illustrated in FIG. 13. A cross-sectional view along line 14—14 in the same figure is illustrated in FIG. 14. It is noted that the same reference symbols denote the same elements in FIG. 13, FIG. 14, FIG. 15, and FIG. 16. In this example, there are the X-directional wires (which will also be referred to as lower wires) 73 corresponding to Dxn of FIG. 7, the Y-directional wires (which will also be referred to as upper wires) 72 corresponding to Dyn of FIG. 7, the conductive films 4, the electron-emitting regions 5, the device electrodes 2, 3, the interlayer insulating layer 131, contact holes 132 for electrical connection between the device electrodes 2 and the lower wires 73, etc. provided on the substrate 1.

Next, the production process will be described in detail according to the order of steps with reference to FIGS. 15 and 16.

(Step A)

Figure 15A:
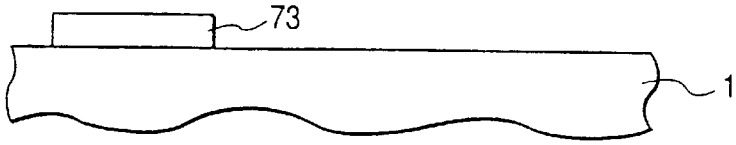
FIG. 15A, FIG. 15B, FIG. 15C, and FIG. 15D are schematic, sectional diagrams showing a process for producing an electron source produced in Example 4.

A soda lime glass plate was cleaned, to obtain a substrate 1, and Cr and Au were successively deposited in the thickness of 50 Å and in the thickness of 6000 Å, respectively, on the substrate 1, by vacuum evaporation. Thereafter, a photoresist was spin-coated by a spinner and baked. Thereafter, the photomask image was exposed and developed to form a resist pattern of the lower wires 73. Then the Au/Cr deposited films were wet-etched to form the lower wires 73 in the desired pattern (FIG. 15A).

(Step B)

Figure 15B:
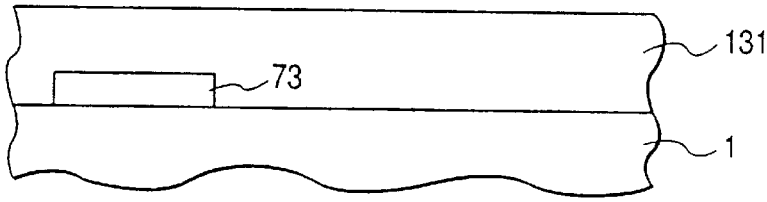

Next, the interlayer insulating layer 131 of a silicon oxide film 1.0 μm thick was deposited by RF sputtering (FIG. 15B).

(Step C)

Figure 15C:
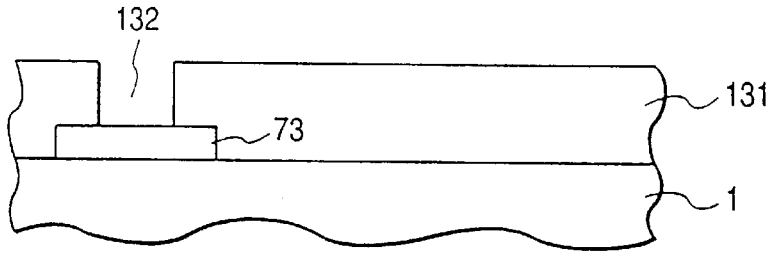

A photoresist pattern for forming the contact holes 132 was formed on the silicon oxide film deposited in step B, and using this as a mask, the interlayer insulating layer 131 was etched to form the contact holes 132. The etching was RIE (Reactive Ion Etching) using $CF_4$ and $H_2$ gases (FIG. 15C).

(Step D)

Figure 15D:
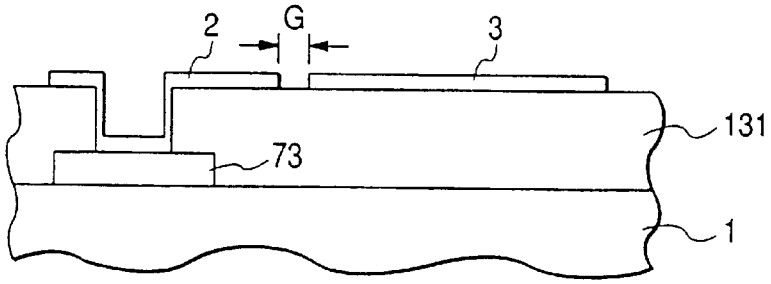

After that, a pattern expected to become the device electrodes 2, 3 and the gaps G between the device electrodes was formed with a photoresist and Ti and Ni were successively deposited thereon in the thickness of 50 Å and in the thickness of 1000 Å, respectively, by vacuum evaporation. The photoresist pattern was dissolved with an organic solvent and the Ni/Ti deposited films were lifted off, thereby forming the device electrodes 2, 3. The device electrode gap G was 10 μm and the device electrode width was 300 μm. Further, Pt was deposited on the back surface of the substrate by sputtering to form the back electrode (not illustrated) (FIG. 15D).

(Step E)

Figure 16A:
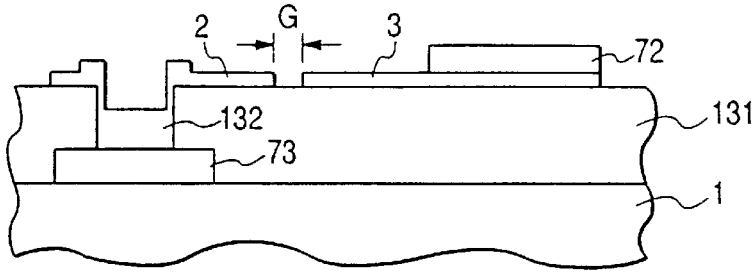
FIG. 16A, FIG. 16B, FIG. 16C, and FIG. 16D are schematic, sectional diagrams showing a process for producing an electron source produced in Example 4.

A photoresist pattern of the upper wires 72 was formed on the device electrodes 2, 3 and thereafter Ti and Au were successively deposited thereon in the thickness of 50 Å and in the thickness of 5000 Å, respectively, by vacuum evaporation. Then unnecessary portions were removed by the lift-off process to form the upper wires 72 in the desired pattern (FIG. 16A).

(Step F)

Figure 16B:
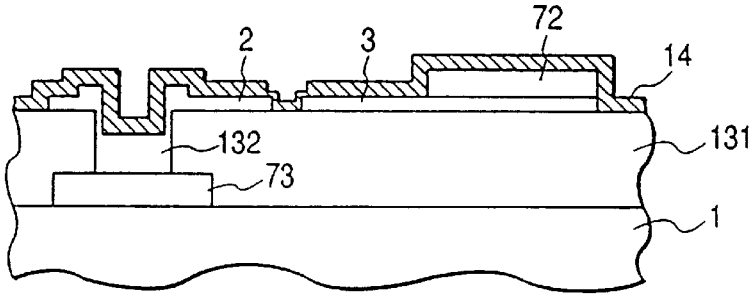

Using a mask with pores at and near the gap G between the device electrodes, a Cr film having the thickness of 1000 angstroms was deposited by vacuum evaporation and patterned, and then organic Pd was spin-coated thereon with the spinner. The heating and baking operation was carried out at 300° C. for ten minutes. The conductive film 4 containing the principal element of Pd thus formed had the thickness of 100 angstroms and the sheet resistance of $5\times10^4$ Ω/□ (FIG. 16B).

(Step G)

Figure 16C:
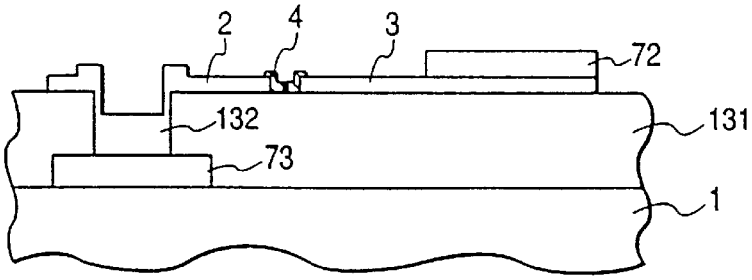

The Cr film and the conductive film 4 after baked were etched with an acid etchant to form the desired pattern (FIG. 16C).

(Step H)

Figure 16D:
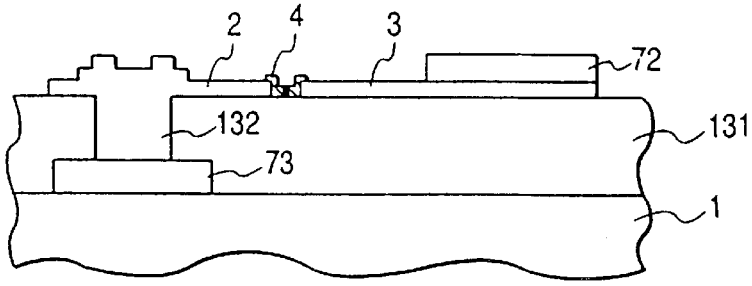

A pattern to coat the other portions than the portions of the contact holes 132 with a resist was formed and Ti and Au were successively deposited thereon in the thickness of 50 Å and in the thickness of 5000 Å, respectively, by vacuum evaporation. Then unnecessary portions were removed by the lift-off process, thereby filling the contact holes 132 (FIG. 16D).

The lower wires 73, the interlayer insulating layer 131, the upper wires 72, the device electrodes 2, 3, and the conductive films 4 were formed on the insulating substrate 1 by the above steps.

Next described referring to FIG. 8 and FIG. 9A is an example in which the image-forming apparatus is constructed using the electron source substrate before the forming operation and prepared as described above.

The electron source substrate 1 provided with the plane type surface conduction electron-emitting devices before the forming operation, prepared as described above, was fixed on the rear plate 81. Then the face plate 86 (constructed by forming the fluorescent film 84 and the metal back 85 on the inside surface of glass substrate 83) was placed 5 mm above the substrate 1 through the support frame 82. Frit glass was applied onto joint portions of the face plate 86, support frame 82, and rear plate 81 and baked at 400° C. to 500° C. in the atmosphere for at least ten minutes to seal them (FIG. 8). The rear plate 81 was also fixed to the substrate 1 with frit glass. Here, the electron source substrate 71 in FIG. 8 is the same one as the above electron source substrate before the forming.

The fluorescent film 84, which would be made of only the fluorescent material in the monochrome case, was formed in the stripe pattern of the fluorescent materials in the present example; specifically, the fluorescent film 84 was made by first forming the black stripes and applying the three primary color fluorescent materials to the gap portions. The fluorescent materials were applied by the slurry method to the glass substrate 83 with a material containing graphite as a matrix, which is commonly used as a material for the black stripes.

The metal back 85 was provided on the inside surface side of the fluorescent film 84. The metal back was made by, after fabrication of the fluorescent film, carrying out a smoothing operation (normally called filming) of the inside surface of the fluorescent film and thereafter depositing Al by vacuum evaporation. The face plate 86 is sometimes provided with a transparent electrode (not illustrated) on the outside surface side of the fluorescent film in order to further enhance the electrical conduction property of the fluorescent film 84, but sufficient electrical conduction was achieved by only the metal back in the present example. Therefore, the transparent electrode was not provided.

Prior to execution of the aforementioned sealing, the position alignment was carried out in order to achieve correspondence between each color fluorescent material and the electron-emitting device in the color case.

The atmosphere inside the glass vessel (envelope) completed as described above was evacuated through the exhaust pipe (not illustrated) by the vacuum pump down to a sufficient vacuum degree. After that, the glass vessel was heated to 60° C. and thereafter the voltage was placed between the device electrodes 2, 3 and the back electrode 6 through the outside terminals Dx1 to Dxm and Dy1 to Dyn. In the present example the voltage was applied for ten minutes while keeping the back electrode 6 at 0 V and the device electrodes 2, 3 at 1 kV. This step can decrease the Na ions near the front surface of the substrate on which the conductive films are formed and the steps after this step, i.e., the steps including the forming, activation, driving, etc., can be performed on a stable basis.

Next, the voltage was placed between the device electrodes 2 and 3 through the outside terminals Dx1 to Dxm and Dy1 to Dyn, thereby effecting the energization forming operation. The voltage waveforms of the forming operation were the same as in FIG. 24.

In the present example the energization forming operation was carried out under a vacuum atmosphere of about $1\times10^{-5}$ Torr with the voltage waveforms having T1 of 1 msec and T2 of 10 msec.

Next, the activation operation was conducted with the same rectangular waves at the peak height of 14 V as in the forming, while measuring the device current $I_f$ and emission current $I_e$. The application of the voltage was carried out in a similar fashion to that in the forming; the voltage was placed between the device electrodes 2, 3 through the outside terminals Dx1 to Dxm and Dy1 and Dyn, whereby the carbon film was deposited around each gap formed by the forming. On this occasion, a voltage, which was determined in consideration with the wiring resistance, was applied from the outside in order to apply the same voltage between the device electrodes in every device. For that purpose, a better method is to carry out the activation of plural devices by successively scanning the application of the voltage with time, so as to obtain uniform characteristics of the respective devices.

The forming and activation operation were carried out to form the electron-emitting regions 5, thereby producing the electron-emitting devices 74. Since the Na ions in the front surface of the substrate became less than before, the steps of the forming and after became stable and the yield was improved thereby. In addition, the variations became smaller in the characteristics among the devices and thus the uniformity was improved drastically.

Then the inside of the envelope was evacuated down to the vacuum degree of about $10^{-6}$ Torr and the exhaust pipe (not illustrated) was heated with a gas burner to be fused, thereby effecting the sealing of the envelope.

Finally, in order to maintain the vacuum degree after the sealing, the getter operation was conducted by the high-frequency heating method.

In the image-forming apparatus (display device) of the present invention completed as described above, the scanning signal and modulation signal were applied each from the unrepresented signal generating means through the outside terminals Dx1 to Dxm, Dy1 to Dyn to each electron-emitting device, whereby each electron-emitting device emitted electrons. A high voltage of several kV or more was applied to the metal back 85 through the high-voltage terminal Hv to accelerate the electron beams. The electron beams hit the fluorescent film 84 to bring about excitation and luminescence, thereby displaying an image.

Example 4

The present example is an example of the image-forming apparatus in which a lot of surface conduction electron-emitting devices are arrayed in the simple matrix configuration. In the present example the voltage application step of Example 3 is carried out at the same time as the sealing step.

The production steps before the sealing step are substantially the same as in Example 3. The steps of the sealing step and after will be described below.

The substrate 1 for electron source, which was prepared through (Step A) to (Step H) of Example 3, was fixed onto the rear plate 81 and thereafter the face plate 86 (which was constructed of the fluorescent film 84 and the metal back 85 formed on the inside surface of the glass substrate 83) was placed 5 mm above the substrate 1 through the support frame 82. Then the frit glass was applied to the joint portions of the face plate 86, the support frame 82, and the rear plate 81 and was baked at 400° C. to 500° C. in the atmosphere or in a nitrogen atmosphere for ten minutes or more to effect the sealing (FIG. 8). At the same time, the positive voltage was applied to the front surface of the substrate while keeping the back surface of the substrate at the ground. A voltage of 10 V was sufficient as the voltage applied. The frit glass was also used for fixing the substrate 1 to the rear plate 81.

The atmosphere inside the glass vessel completed as described above was evacuated to a sufficient vacuum degree through the exhaust pipe (not illustrated) by the vacuum pump. After that, the voltage was applied between the device electrodes 2 and 3 through the outside terminals Dx1 to Dxm and Dy1 to Dyn, thereby effecting the forming operation. The voltage waveforms in the forming operation were the same as in FIG. 24.

In the present example the energization forming operation was carried out under a vacuum atmosphere of about $1\times10^{-5}$ Torr with the voltage waveforms having T1 of 1 msec and T2 of 10 msec.

Next, the activation operation was conducted with the same rectangular waves at the peak height of 14 V as in the forming, while measuring the device current $I_f$ and emission current $I_e$. The application of the voltage was carried out in a similar fashion to that in the forming; the voltage was placed between the device electrodes 2, 3 through the outside terminals Dx1 to Dxm and Dy1 and Dyn, whereby the carbon film was deposited around each gap formed by the forming operation. On this occasion, a voltage, which was determined in consideration with the wiring resistance, was applied from the outside in order to apply the same voltage between the device electrodes in every device. For that purpose, a better method is to carry out the activation of plural devices by successively scanning the application of the voltage with time, so as to obtain uniform characteristics of the respective devices.

The forming and activation operations were carried out to form the electron-emitting regions 5, thereby producing the electron-emitting devices 74. Since the Na ions in the front surface of the substrate became less than in Example 3, the steps after the forming became stable and the yield was improved thereby. In addition, the variations became smaller in the characteristics among the devices and thus the uniformity was improved drastically. Further, since the sealing step and the voltage application step were carried out simultaneously, the steps were able to be decreased. In addition, since the high temperature during the sealing was able to be utilized, the voltage applied was decreased and there remained no electric field in the substrate after the application of voltage.

Then the inside of the envelope was evacuated down to the vacuum degree of about $10^{-6}$ Torr and the exhaust pipe (not illustrated) was heated with a gas burner to be fused, thereby effecting the sealing of the envelope.

Finally, in order to maintain the vacuum degree after the sealing, the getter operation was conducted by the high-frequency heating method.

In the image-forming apparatus (display device) of the present invention completed as described above, the scanning signal and modulation signal were applied each from the unrepresented signal generating means through the outside terminals Dx1 to Dxm, Dy1 to Dyn to each electron-emitting device, whereby each electron-emitting device emitted electrons. A high voltage of several kV or more was applied to the metal back 85 through the high-voltage terminal Hv to accelerate electron beams. The electron beams hit the fluorescent film 84 to bring about excitation and luminescence, thereby displaying an image.

Example 5

In the present example the electron source substrate with the electron-emitting devices arrayed in a matrix was formed by a printing method.

The production steps of the electron source formed in the present example will be described below referring to FIGS. 20A to 20C, FIGS. 21A to 21C, and FIGS. 23A to 23D. Although FIGS. 20A to 20C and 21A to 21C shows only nine devices for simplicity of explanation, the array of devices in the present example was a matrix of 500 devices in the row direction (X-direction) and 1500 devices in the column direction (Y-direction).

(Step 1)

First, a back electrode layer of Cr was placed on one principal surface of a soda lime glass plate having two opposed principal surfaces, thereby forming a second principal surface. A layer of $SiO_2$ was then formed in the thickness of 0.5 $\mu$m on the other principal surface by sputtering, thereby forming a first principal surface.

Figure 23A:
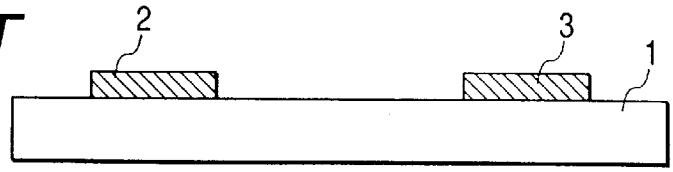
FIG. 23A PRIOR ART
FIG. 23A, FIG. 23B, FIG. 23C, and FIG. 23D are schematic diagrams to show a process for producing a conventional surface conduction electron-emitting device.

Then the paired device electrodes 2, 3 were formed in the array of 500×1500 sets on the first principal surface (FIG. 20A and FIG. 23A). The device electrodes were formed by the offset printing method. Specifically, an organic Pt paste containing Pt was filled into an intaglio having recess portions in the pattern of the device electrodes 2, 3 and this paste was transferred onto the substrate 1. Then the ink transferred was heated and baked to form the device electrodes 2, 3 made of Pt.

(Step 2)

Next, the column-directional wires 73 (X-directional wires or lower wires) were formed so as to be in contact with one side of the electrodes 2 of the device electrodes (FIG. 20B). The wires 73 were formed by the screen printing method. Specifically, an Ag paste was printed onto the substrate 1 through a screen having apertures in the pattern of the column-directional wires and then the paste thus printed was heated and baked to form the wires 73 made of Ag.

(Step 3)

Next, the interlayer insulating layer 75 was formed at the intersecting portions between the column-directional wires 73 and the row-directional wires (FIG. 20C). The interlayer insulating layer 75 was formed by the screen printing method. The shape of the interlayer insulating layer was such a comb teeth shape as to cover the intersecting portions between the column-directional wires and the row-directional wires and has depressed portions for permitting connection between the row-directional wires and the device electrodes 3. Specifically, a glass paste, which was a mixture of glass binder and resin in the matrix of lead oxide, was printed onto the substrate 1 through a screen having apertures in the pattern of the interlayer insulating layer and then the paste thus printed was heated and baked to form the interlayer insulating layer 75.

(Step 4)

Next, the row-directional wires 72 (Y-directional wires or upper wires) were formed so as to be in contact with one-side of the electrodes 3 of the device electrodes (FIG. 21A). The wires 72 were formed by the screen printing method. Specifically, an Ag paste was printed onto the substrate 1 through a screen having apertures in the pattern of the row-directional wires and then the paste thus printed was heated and baked to form the wires 72 made of Ag.

(Step 5)

Figure 23B:
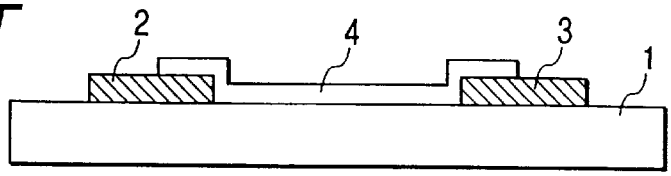
FIG. 23B PRIOR ART

Next, the conductive films 4 were formed so as to achieve a connection between the device electrodes 2, 3 (FIG. 21B and FIG. 23B). The conductive films 4 were formed by the bubble jet method, which was one of the ink jet methods. Specifically, droplets of an aqueous solution of a Pd organometallic compound: 0.15%, isopropyl alcohol: 15%, ethylene glycol: 1%, and polyvinyl alcohol: 0.05% were dispensed to between the device electrodes of each device by the ink jet method.

Subsequently, the solution was baked at 350° C. in the atmosphere to form the conductive films 4 of PdO.

The electron source substrate before the forming operation was formed through the above steps.

(Step 6)

Then the electron source substrate 1 before the forming operation, prepared through the above steps, was subjected to the electric field application step for two hours at room temperature. Specifically, all the row-directional (Y-directional) wires and the column-directional (X-directional) wires were set to 1 kV. At the same time, the back electrode was set to 0 V.

The electron source substrate 1 from the first principal surface side of which the Na ions were reduced was formed as described above.

(Step 7)

Then the electron source substrate 1 before the forming operation through the above electric field application step was placed in a chamber (not illustrated) and the inside was evacuated down to about $1\times10^{-5}$ Torr.

Figure 23C:
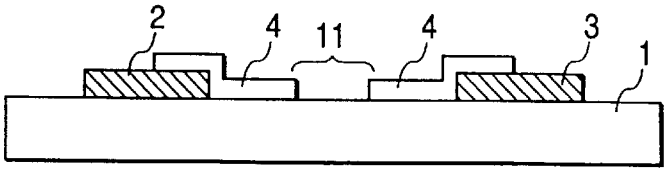
FIG. 23C PRIOR ART
Figure 23D:
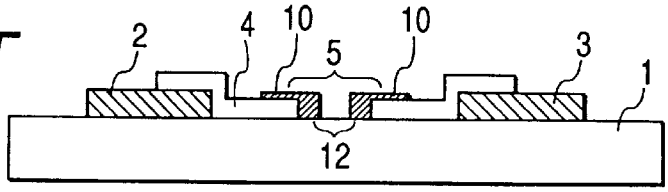
FIG. 23D PRIOR ART

Then the forming operation was carried out in a similar fashion to that in Example 4 through a X-directional wires 73 and the Y-directional wires 72, thereby forming the gaps 11 in part of the conductive films 4 (FIG. 23C). The maximum voltage applied in the forming step was 5.1 V. Subsequently, the energization activation operation was carried out with the waveforms illustrated in FIG. 25 to form carbon films on the gaps formed in the forming operation and on the conductive films near the gaps, thereby forming the electron-emitting regions 5 (FIG. 21C and FIG. 23D). In the energization activation step an organic gas (benzonitrile) was introduced up to $10^{-4}$ Torr into the chamber, whereby the organic gas was kept in contact with the aforementioned gaps. In this state the constant voltage pulses of 15 V were then applied to the conductive films through the X-directional wires 73 and the Y-directional wires 72.

(Step 8)

Next, the inside of the chamber was evacuated down to $10^{-10}$ Torr while heating the chamber and the electron source substrate 1. During this heating, the electric field application step as carried out in step 6 was carried out during the heating period (from the start of temperature increase to the cooled state at room temperature).

This electric field application step is a step for suppressing diffusion of the Na ions into the conductive films or into the $SiO_2$ layer due to the heating. As a consequence, the electron emission characteristics of each electron-emitting device do not vary during the above evacuation step and the devices can be driven with the electron emission characteristics similar to those in the state just after the completion of the activation operation.

The electron emission characteristics were measured for each device of the electron source substrate formed as described above and it was confirmed that the electron source obtained was an excellent one with high uniformity and with little variation among the devices even after long-term driving.

Example 6

In the present example the image-forming apparatus illustrated in FIG. 8 was formed using the electron source with the devices in the matrix configuration similar to that in Example 5. In the image-forming apparatus produced in the present example, the electron source substrate 71 also serves as a rear plate 81.

In the present example the electric field application step was conducted during the heating step in the process for forming the image-forming apparatus.

In the present example the electron source substrate was formed in the same manner up to step 7 of Example 5.

(Step 8)

The support frame 82, which was prepared by preliminarily placing the frit glass on each of the joint part with the electron source substrate 1 and the joint part with the face plate 86, was mounted on the electron source substrate 1 produced before step 8. At the same time, the spacer (not illustrated) was also placed on some upper wires 72.

Further, the face plate 86, on which the fluorescent film 84 and metal back 85 were placed, was mounted on the above support frame 82, so as to combine the face plate, the support frame, and the rear plate.

The electron source substrate 1 described in the above process corresponds to the rear plate 81 of FIG. 8.

(Step 9)

The members combined in above step 8 were heated to effect sealing. The electric field application step was carried out at the same time as this heating.

Specifically, the voltage of 100 V was applied to each of the X-directional wires and Y-directional wires and 0 V was placed on the back electrode.

This application of the electric field was always carried on during the above sealing period (from the start of temperature increase to the cooled state at room temperature). The envelope 88 illustrated in FIG. 8 was formed by the above sealing step.

(Step 10)

Next, the inside of the envelope 88 was evacuated through the exhaust pipe (not illustrated) and the exhaust pipe was heated and sealed at the time of arrival at a sufficient vacuum degree, thereby obtaining an airtight vessel.

This evacuation step was carried out while heating the envelope 88. This step was conducted while applying the electric field during the heating period (from the start of temperature increase to the cooled state at the room temperature) as well, similar to that in step 9.

The electric field application steps in step 9 and step 10 were steps for suppressing diffusion of the Na ions into the conductive films or into the $SiO_2$ layer due to the heating during the production steps of the image-forming apparatus. As a result, the electron emission characteristics of each electron-emitting device do not vary during the production steps of the image-forming apparatus and the devices can be driven in the state before the sealing, thereby obtaining a uniform image.

When the image signal was inputted to the terminals outside the airtight vessel obtained as described above, similarly to Example 3, images with high luminance and high uniformity were obtained on a stable basis over a long period.

Example 7

Figure 17:
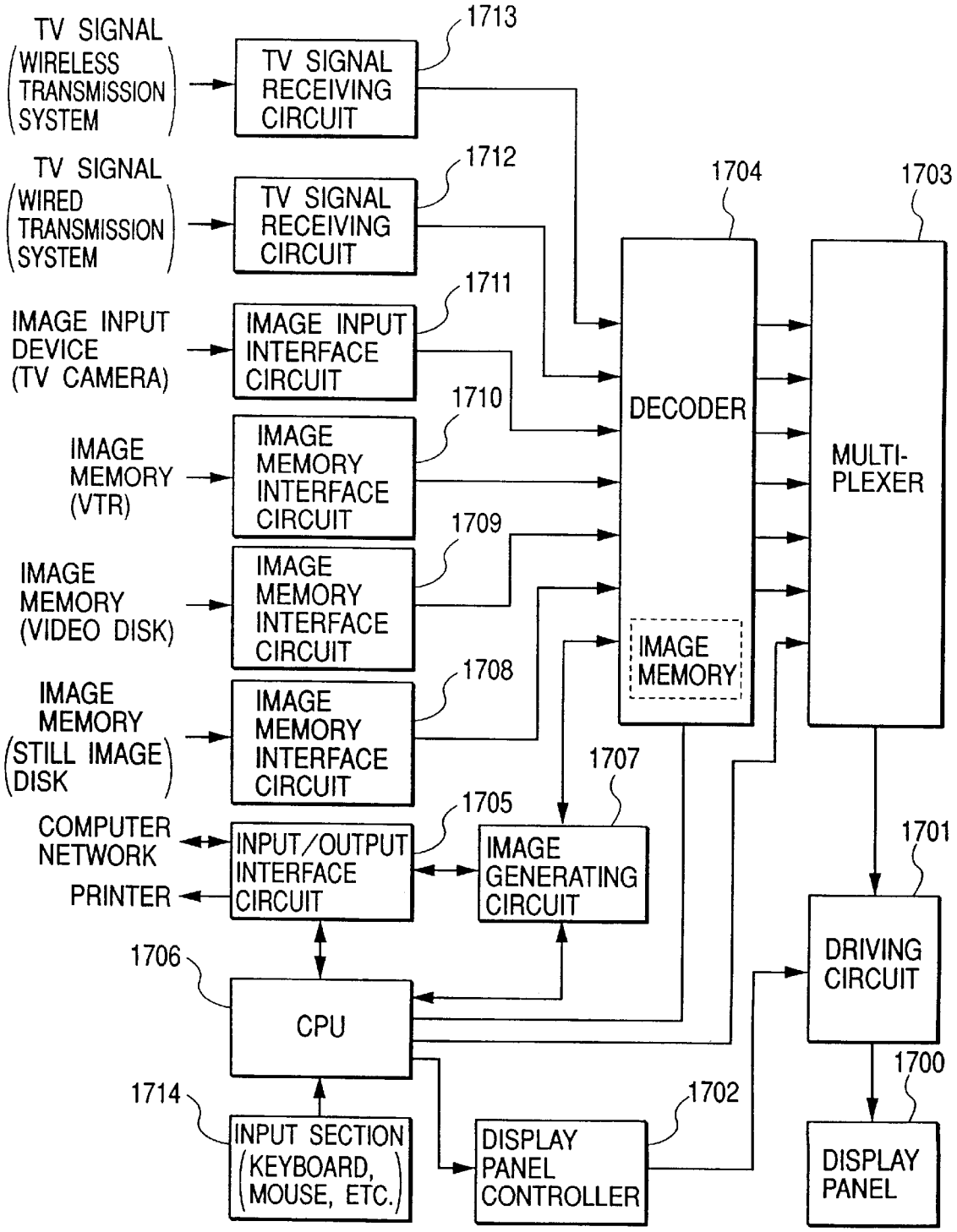
FIG. 17 is a schematic diagram to show a driving circuit for driving a display produced in Example 7.

FIG. 17 is a diagram to show an example of the image-forming apparatus (display device) adapted to display image information provided from various image information sources, for example, including the television broadcasting and the like, on a display panel using the surface conduction electron-emitting devices described above as an electron beam source. In the figure, numeral 1700 represents a display panel, 1701 a driving circuit of the display panel, 1702 a display panel controller, 1703 a multiplexer, 1704 a decoder, 1705 an I/O interface circuit, 1706 a CPU, 1707 an image-generating circuit, 1708, 1709, and 1710 image memory interface circuits, 1711 an image input interface circuit, 1712 and 1713 TV signal receiving circuits, and 1714 an input unit. (The present image-forming apparatus (display device) is arranged to reproduce sound together with the display of an image when receiving a signal including both an image signal and a sound signal, for example, like a television signal; however, description is omitted herein for circuits, loudspeakers, etc. concerning reception, separation, regeneration, processing, storage, etc. of the sound information not directly related to the features of the present invention.)

The functions of the respective units will be described along the flow of an image signal.

First, the TV signal receiving circuit 1713 is a circuit for receiving the TV signal transmitted through a wireless communication system, for example, such as radio waves, space optical communication, or the like. There are no specific restrictions on the system of the TV signal received and either system can be selected, for example, from various systems such as the NTSC system, the PAL system, the SECAM system, and so on. TV signals comprised of more scanning lines than those by such systems (for example, so-called high-definition TV signals by the MUSE method etc.) are preferred signal sources for taking advantage of the features of the display panel suitable for large-area display and the large number of pixels. The TV signal received by the above TV signal receiving circuit 1713 is outputted to the decoder 1704.

The TV signal receiving circuit 1712 is a circuit for receiving the TV signal transmitted through a wire communication system, for example, such as a coaxial cable, an optical fiber, or the like. Similarly to the TV signal receiving circuit 1713, there are no specific restrictions on the system of the TV signal received and the TV signal received by this circuit is also outputted to the decoder 1704.

The image input interface circuit 1711 is a circuit for capturing an image signal supplied from an image input device, for example, such as a TV camera, an image reading scanner, or the like, and the image signal thus captured is outputted to the decoder 1704.

The image memory interface circuit 1710 is a circuit for capturing an image signal stored in a video tape recorder (hereinafter referred to as VTR) and the image signal thus captured is outputted to the decoder 1704.

The image memory interface circuit 1709 is a circuit for capturing an image signal stored in a video disk and the image signal thus captured is outputted to the decoder 1704.

The image memory interface circuit 1708 is a circuit for capturing an image signal from a device storing still image data, such as a so-called still image disk, and the still image date thus captured is inputted into the decoder 1704.

The I/O interface circuit 1705 is a circuit for connecting the present image-forming apparatus (display device) to an external output device such as a computer, a computer network, or a printer. This circuit permits input/output of image data or character and graphic information, of course, and also permits input/output of control signals and numerical data between the CPU 1706 in the present image-forming apparatus (display device) and the outside in certain cases.

The image-generating circuit 1707 is a circuit for forming image data for display, based on the image data or the character and graphic information inputted from the outside through the I/O interface circuit 1705 or based on the image data or the character and graphic information output from the CPU 1706. This circuit incorporates circuits necessary for formation of an image, for example, including a writable memory for storing the image data or the character and graphic information, a read-only memory for storing image patterns corresponding to character codes, a processor for carrying out image processing, and so on.

The image data for display formed by this circuit is output to the decoder 1704 and in some cases it can also be output through the I/O interface circuit 1705 to an external computer network or printer.

The CPU 1706 mainly performs control of the operation of this image-forming apparatus (display device) and operations concerning formation, selection, and editing of a display image. For example, it outputs a control signal to the multiplexer 1703, it properly selects an image signal to be displayed on the display panel, or it properly combines image signals to be displayed. On that occasion the CPU generates a control signal to the display panel controller 1702 according to the image signal to be displayed, to properly control the operation of the image-forming apparatus (display device) as to the screen display frequency, the scanning method (for example, either interlace or non-interlace), the number of scanning lines in one screen, and so on.

The CPU also directly outputs the image data or the character and graphic information to the image-generating circuit 1707 or makes access to an external computer or memory through the I/O interface circuit 1705 to take in the image data or the character and graphic information. The CPU 1706 may also be adapted to be engaged in operations for purposes other than above, as a matter of course. For example, the CPU may be associated directly with the function to form or process information, like a personal computer, a word processor, or the like; or, as described previously, the CPU may be connected to an external computer network through the I/O interface circuit 1705 to perform an operation, for example, such as numerical computation or the like, in cooperation with an external device.

The input unit 1714 is a device through which a user inputs a command, a program, or data to the CPU 1706, which can be selected from a variety of input devices, for example, such as a keyboard, a mouse, a joy stick, a bar-code reader, a voice recognition unit, and so on.

The decoder 1704 is a circuit for inverting the various image signals input from the circuits 1707 to 1713 to three-primary-color signals, or to luminance signals, and I signals and Q signals. The decoder 1704 is desirably provided with an image memory inside, as indicated by a dotted line in the same figure. This is for handling the TV signal necessitating the image memory on the occasion of inversion, for example, in the case of the MUSE system and the like.

Provision of the image memory facilitates the display of a still image, or presents an advantage of facilitating the image processing and editing, including thinning, interpolation, enlargement, reduction, and synthesis of the image, in cooperation with the image-generating circuit 1707 and CPU 1706.

The multiplexer 1703 operates to properly select the display image, based on a control signal supplied from the CPU 1706. Namely, the multiplexer 1703 selects a desired image signal out of the inverted image signals supplied from the decoder 1704 and outputs the selected image signal to the driving circuit 1701. In that case, it is also possible to select image signals in a switched manner within one screen display time, thereby displaying different images in plural areas in one screen, like a so-called multi-screen television.

The display panel controller 1702 is a circuit for controlling the operation of the driving circuit 1701, based on a control signal supplied from the CPU 1706.

Concerning the basic operation of the display panel, the controller outputs a signal for controlling the operational sequence of the power supply (not illustrated) for driving the display panel, to the driving circuit 1701, for example. Concerning the driving method of the display panel, the controller outputs signals for controlling the screen display frequency and the scanning method (for example, either interlace or non-interlace) to the driving circuit 1701, for example.

In some cases, the controller outputs control signals associated with adjustment of image quality, such as luminance, contrast, color tone, and sharpness of the display image, to the driving circuit 1701.

The driving circuit 1701 is a circuit for generating a drive signal applied to the display panel 1700 and operates based on an image signal supplied from the multiplexer 1703 and a control signal supplied from the display panel controller 1702.

The functions of the respective units described above and the structure exemplified in FIG. 17 permits this image-forming apparatus (display device) to display the image information supplied from various image information sources on the display panel 1700. Specifically, the various image signals, including the television broadcasting, etc., are inverted in the decoder 1704 and thereafter an image signal is properly selected therefrom in the multiplexer 1703. The selected image signal is input into the driving circuit 1701.

On the other hand, the display controller 1702 generates a control signal for controlling the operation of the driving circuit 1701 according to the image signal to be displayed. The driving circuit 1701 applies a drive signal to the display panel 1700, based on the image signal and the control signal. This causes an image to be displayed on the display panel 1700. These sequential operations are systematically controlled by the CPU 1706.

The present image-forming apparatus (display device) can display selected information out of the data stored in the image memory incorporated in the decoder 1704 and the data formed by the image-generating circuit 1707 and can also perform the following operations for the image information to be displayed; for example, image processing including enlargement, reduction, rotation, movement, edge enhancement, thinning, interpolation, color conversion, aspect ratio conversion of image, and so on, and image editing including synthesis, erasing, connection, exchange, paste, and so on. The apparatus may also be provided with a dedicated circuit for carrying out processing and editing of sound information, similar to the above image processing and image editing, though it was not mentioned in the description of the present example.

Therefore, this single image-forming apparatus (display device) can function as a display device for television broadcasting, as terminal equipment for a video conference, as an image editing device for handling a still image and a dynamic image, as terminal equipment of a computer, as terminal equipment for office use such as a word processor and the like, and as a game device and thus has a very wide application range for industries or for consumer use.

FIG. 17 is just an example of the configuration where the image-forming apparatus (display device) incorporates the display panel using the surface conduction electron-emitting devices as an electron beam source and it is needless to mention that the image-forming apparatus of the present invention is not limited to only this example. For example, no trouble will arise even if the circuits associated with the functions that are not necessary for the purpose of use are omitted out of the components of FIG. 17. On the other hand, an additional component may be added depending upon the purpose of use. For example, where the present image-forming apparatus (display device) is applied as a video telephone, the apparatus is preferably provided with additional components such as a video camera, a sound microphone, an illuminating device, a transmitter-receiver circuit including a modem, and so on.

In this image-forming apparatus (display device), since the display panel using the surface conduction electron-emitting devices as an electron beam source can readily be made thinner in particular, the depth of the image-forming apparatus (display device) can be decreased.

In addition, the display panel using the surface conduction electron-emitting devices as an electron beam source can be formed readily in a large screen, has high luminance, and is excellent in viewing angle characteristics; therefore, the present image-forming apparatus (display device) can display an image of strong appeal with full presence and with high visibility.

As described above, the present invention made it possible to decrease the Na ions from the front surface of the substrate by the production process of the electron-emitting device comprised of the pair of opposed device electrodes and the thin film having the electron-emitting region formed on the substrate, the production process comprising at least the step of forming the pair of device electrodes, the step of forming the thin film (having the electron-emitting region), the step of applying the voltage to the substrate, and the forming step and activation step. As a result, the production steps thereafter become stable and the yield is increased.

The frit for fixing the support frame can be prevented from reacting with the Na ions in the rear plate.

Further, the electron emission characteristics become stable.

In addition, since the inexpensive soda lime glass can be used for the rear plate, the cost is lowered.

Further, the electron sources for emitting electrons according to the input signal can be produced on a stable basis and in good yield when the electron sources are formed in either one selected from the configuration in which the electron source comprises a plurality of above-stated electron-emitting devices on the substrate, the plurality of electron-emitting devices being arranged in parallel on the substrate, there are a plurality of rows of electron-emitting devices connected at both ends of each device to wires, and the modulating means is provided, or the configuration in which a plurality of electron-emitting devices are arrayed on the substrate and the paired device electrodes of the electron-emitting devices are connected to m X-directional wires and n Y-directional wires electrically insulated from each other. Since the uniformity was improved, the loads on the peripheral circuits, etc. were also reduced and, therefore, the inexpensive apparatus was able to be provided.

The image-forming apparatus is a device for forming an image, based on the input signal, and the image-forming apparatus is characterized by comprising at least the image-forming member and the electron source; therefore, the electron emission characteristics are improved under stable control. For example, the image-forming apparatus with the fluorescent member as an image-forming member realized a device for forming the uniform image at low current, for example, a flat color television.

What is claimed is:

1. A method for producing an electron-emitting device, said method comprising the steps of:

a step of preparing a sodium-containing substrate having a first principal surface and a second principal surface opposed to each other;

a step of forming an electroconductive film on the first principal surface;

an electric field application step of applying an electric field to cause a potential of the first principal surface to become higher than a potential of the second principal surface, to cause at least one sodium ion existing in a side of the first principal surface to move to a side of the second principal surface, thereby reducing a concentration of sodium ions in the side of the first principal surface and minimizing an influence of sodium ions during an energization step of energizing said electroconductive film; and an energization step of energizing said electroconductive film after the electric field application step.

2. The production method of the electron-emitting device according to claim 1, wherein said energization step is an energization forming step of forming a gap in said electroconductive film.

3. The production method of the electron-emitting device according to claim 2, further comprising an energization activation step of energizing said electroconductive film while a gas containing an organic substance is kept in contact with the vicinity of said gap.

4. The production method of the electron-emitting device according to claim 1, wherein said electric field application step is a step of applying different potentials to an electrode disposed on said first principal surface and to an electrode disposed on said second principal surface.

5. The production method of the electron-emitting device according to claim 4, wherein the electrode disposed on said first principal surface is a pair of electrodes connected to said electroconductive film.

6. The production method of the electron-emitting device according to claim 1, wherein said electric field application step is carried out while heating said substrate.

7. The production method of the electron-emitting device according to claim 6, wherein said electric field application step is a step of applying different potentials to an electrode disposed on said first principal surface and to an electrode disposed on said second principal surface.

8. The production method of the electron-emitting device according to claim 7, wherein said electrode disposed on said first principal surface is a pair of electrodes and said electroconductive film is connected to said pair of electrodes.

9. The production method of the electron-emitting device according to claim 6, wherein said electric field application step is carried out during a period equal to a period of said heating.

10. The production method of the electron-emitting device according to claim 1, further comprising a second electric field application step of applying such an electric field that a potential of said first principal surface becomes higher than a potential of said second principal surface, after said energization step.

11. The production method of the electron-emitting device according to claim 10, wherein said energization step comprises:

an energization forming step of forming a gap in said electroconductive film; and an energization activation step of energizing said electroconductive film while a gas containing an organic substance is kept in contact with the vicinity of said gap.

12. The production method of the electron-emitting device according to claim 10, wherein said second electric field application step is carried out while heating said substrate.

13. The production method of the electron-emitting device according to claim 12, wherein said second electric field application step is a step of applying different potentials to an electrode disposed on said first principal surface and to an electrode disposed on said second principal surface.

14. The production method of the electron-emitting device according to claim 13, wherein said electrode disposed on said first principal surface is plural sets of electrode pairs, each said electrode pair being connected to a respective electroconductive film.

15. The production method of the electron-emitting device according to claim 12, wherein said second electric field application step is carried out, at least, during a period equal to a period of said heating.

16. A method for producing an electron source substrate, said method comprising the steps of:

a step of preparing a sodium-containing substrate having a first principal surface and a second principal surface opposed to each other;

a step of forming a plurality of electroconductive films on the first principal surface;

an electric field application step of applying an electric field to cause a potential of the first principal surface to become higher than a potential of the second principal surface, to cause at least one sodium ion existing in a side of the first principal surface to move to a side of the second principal surface, thereby reducing a concentration of sodium ions in the side of the first principal surface and minimizing an influence of sodium ions during an energization step of energizing said electroconductive film; and an energization step of energizing said plurality of electroconductive films after the electric field application step.

17. The production method of the electron source substrate according to claim 16, wherein said energization step is an energization forming step of forming a gap in said electroconductive films.

18. The production method of the electron source substrate according to claim 17, further comprising an energization activation step of energizing said electroconductive films while a gas containing an organic substance is kept in contact with the vicinity of said gap.

19. The production method of the electron source substrate according to claim 16, wherein said electric field application step is a step of applying different potentials to an electrode disposed on said first principal surface and to an electrode disposed on said second principal surface.

20. The production method of the electron source substrate according to claim 19, wherein said electrode disposed on said first principal surface is plural sets of electrode pairs, each said electrode pair being connected to a respective one of said electroconductive films.

21. The production method of the electron source substrate according to claim 16, wherein said electric field application step is carried out while heating said substrate.

22. The production method of the electron source substrate according to claim 21, wherein said electric field application step is a step of applying different potentials to an electrode disposed on said first principal surface and to an electrode disposed on said second principal surface.

23. The production method of the electron source substrate according to claim 22, wherein said electrode disposed on said first principal surface is plural sets of electrode pairs, each said electrode pair being connected to a respective one of said electroconductive films.

24. The production method of the electron source substrate according to claim 21, wherein said electric field application step is carried out, at least, during a period equal to a period of said heating.

25. The production method of the electron source substrate according to claim 16, further comprising a second electric field application step carried out after said energization step.

26. The production method of the electron source substrate according to claim 25, wherein said energization step comprises:

an energization forming step of forming a gap in said electroconductive films; and an energization activation step of energizing said electroconductive films while a gas containing an organic substance is kept in contact with the vicinity of said gap.

27. The production method of the electron source substrate according to claim 25, wherein said second electric field application step is carried out while heating said substrate.

28. The production method of the electron source substrate according to claim 27, wherein said electric field application step is a step of applying different potentials to an electrode disposed on said first principal surface and to an electrode disposed on said second principal surface.

29. The production method of the electron source substrate according to claim 28, wherein said electrode disposed on said first principal surface is plural sets of electrode pairs, each said electrode pair being connected to a respective one of said electroconductive films.

30. The production method of the electron source substrate according to claim 27, wherein said second electric field application step is carried out, at least, during a period equal to a period of said heating.

31. A method for producing an image-forming apparatus, said method comprising the steps of:

a step of preparing a sodium-containing substrate having a first principal surface and a second principal surface;

a step of placing a plurality of electroconductive films on the first principal surface;

an electric field application step of applying an electric field to cause a potential of the first principal surface to become higher than a potential of the second principal surface, to cause at least one sodium ion existing in a side of the first principal surface upon which said plurality of electroconductive films are placed, to move to a side of the second principal surface, thereby reducing a concentration of sodium ions in the side of the first principal surface and minimizing an influence of sodium ions during an energization step of energizing said plurality of electroconductive films;

an energization step of energizing said plurality of electroconductive films after the electric field application step; and a step of placing a substrate having an image-forming member opposite to the first principal surface on which said electroconductive films are placed.

32. The production method of the image-forming apparatus according to claim 31, wherein said energization step is an energization forming step of forming a gap in said electroconductive films.

33. The production method of the image-forming apparatus according to claim 32, further comprising an energization activation step of energizing said electroconductive films while a gas containing an organic substance is kept in contact with the vicinity of said gap.

34. The production method of the image-forming apparatus according to claim 31, wherein said electric field application step is a step of applying different potentials to an electrode disposed on said first principal surface and to an electrode disposed on said second principal surface.

35. The production method of the image-forming apparatus according to claim 34, wherein said electrode disposed on said first principal surface is plural sets of electrode pairs, each said electrode pair being connected to a respective one of said electroconductive films.

36. The production method of the image-forming apparatus according to claim 31, wherein said electric field application step is carried out while heating said substrate.

37. The production method of the image-forming apparatus according to claim 36, wherein said electric field application step is a step of applying different potentials to an electrode disposed on said first principal surface and to an electrode disposed on said second principal surface.

38. The production method of the image-forming apparatus according to claim 37, wherein said electrode disposed on said first principal surface is plural sets of electrode pairs, each said electrode pair being connected to a respective one of said electroconductive films.

39. The production method of the image-forming apparatus according to claim 36, wherein said electric field application step is carried out, at least, during a period equal to a period of said heating.

40. The production method of the image-forming apparatus according to claim 31, wherein the step of placing said substrate having said image-forming member opposite to said first principal surface is:

a sealing step of heating said sodium-containing substrate, said substrate having said image-forming member, and a joint member for joining the two substrates to each other, thereby effecting the joining.

41. The production method of the image-forming apparatus according to claim 40, wherein said electric field application step is carried out at the same time as said sealing step.

42. The production method of the image-forming apparatus according to claim 41, wherein said electric field application step is a step of applying different potentials to an electrode disposed on said first principal surface and to an electrode disposed on said second principal surface.

43. The production method of the image-forming apparatus according to claim 42, wherein said electrode disposed on said first principal surface is plural sets of electrode pairs, each said electrode pair being connected to a respective one of said electroconductive films.

44. The production method of the image-forming apparatus according to claim 41, wherein said electric field application step is carried out, at least, during a period equal to a period of said heating in said sealing step.

45. The production method of the image-forming apparatus according to claim 40, wherein said sealing step is carried out after said energization step.

46. The production method of the image-forming apparatus according to claim 45, further comprising a second electric field application step of applying such an electric field that a potential of said first principal surface becomes higher than a potential of said second principal surface, after said energization step.

47. The production method of the image-forming apparatus according to claim 45, wherein said energization step comprises:

an energization forming step of forming a gap in said electroconductive films; and an energization activation step of energizing said electroconductive films while a gas containing an organic substance is kept in contact with the vicinity of said gap.

48. The production method of the image-forming apparatus according to claim 45, wherein a further electric field application step of applying such an electric field that a potential of said first principal surface becomes higher than a potential of said second principal surface is carried out at the same time as the heating in said sealing step.

49. The production method of the image-forming apparatus according to claim 48, wherein said further electric field application step is a step of applying different potentials to an electrode disposed on said first principal surface and to an electrode disposed on said second principal surface.

50. The production method of the image-forming apparatus according to claim 49, wherein said electrode disposed on said first principal surface is plural sets of electrode pairs, a respective one of said electrode pair being connected to a respective one of said electroconductive films.

51. The production method of the image-forming apparatus according to claim 48, wherein said further electric field application step is carried out, at least, during a period equal to a period of said heating in said sealing step.

52. The production method of the image-forming apparatus according to claims 41 or 45, comprising an evacuation step of evacuating a space between said sodium-containing substrate and said substrate having the image-forming member to a depressurized state, after said sealing step.

53. The production method of the image-forming apparatus according to claim 52, wherein said evacuation step is carried out while heating said sodium-containing substrate, and wherein a further electric field application step of applying such an electric field that a potential of said first principal surface becomes higher than a potential of said second principal surface is carried out on the occasion of the heating.

54. The production method of the image-forming apparatus according to claim 53, wherein said electric field application step in said evacuation step is a step of applying different potentials to an electrode disposed on said first principal surface and to an electrode disposed on said second principal surface.

55. The production method of the image-forming apparatus according to claim 54, wherein said electrode disposed on said first principal surface is plural sets of electrode pairs, each said electrode pair being connected to a respective one of said electroconductive films.

56. The production method of the image-forming apparatus according to claim 53, wherein said further electric field application step is carried out, at least, during a period equal to a period of the heating in said evacuation step.

57. A method for producing an electron-emitting device, comprising the steps of:

(A) preparing a substrate having first and second principal surfaces opposed to each other, and comprising sodium;

(B) forming a conductive film on the first principal surface;

(C) setting the first principal surface to a higher potential than the second principal surface to cause at least one sodium ion existing in a side of the first principal surface to be moved to a side of the second principal surface, thereby reducing a concentration of sodium ions in the side of the first principal surface and minimizing an influence of sodium ions during an energizing of the conductive film; and (D) energizing the conductive film in a state while the at least one sodium ion moves to the side of the second principal surface.

58. A method for producing an electron source in which a plurality of electron-emitting devices are arranged, wherein the election-emitting devices are produced in accordance with the method of claim 57.

59. A method for producing an image forming apparatus having an electron source and an image forming member, wherein the electron source is produced according to the method of claim 58.

60. A method according to claim 57, wherein the conductive film is energized to form a gap in the conductive film.

61. A method for producing an electron source in which a plurality of electron-emitting devices are arranged, wherein the electron-emitting devices are produced according to the method of claim 60.

62. A method for producing an image forming apparatus comprising an electron source and an image forming member, wherein the electron source is produced according the method of claim 61.

63. A method for producing an electron-emitting device according to claim 57, wherein the conductive film has a gap therein, and wherein the conductive film is energized to cause a carbon film to be formed within the gap.

64. A method for producing an electron source in which a plurality of electron-emitting devices are arranged, wherein the electron-emitting devices are produced according to the method of claim 63.

65. A method for producing an image forming apparatus comprising an electron source and an image forming member, wherein the electron source is produced according the method of claim 64.

66. A method for producing an electron-emitting device according to claim 57, further comprising a step of forming a gap through the conductive film to separate first and second portions of the conductive film from one another, and wherein the conductive film is energized to form a carbon film within the gap.

67. A method for producing an electron source in which a plurality of electron-emitting devices are arranged, wherein the electron-emitting devices are produced according to the method of claim 66.

68. A method for producing an image forming apparatus comprising an electron source and an image forming member, wherein the electron source is produced according the method of claim 67.

* * * * *

UNITED STATES PATENT AND TRADEMARK OFFICE

CERTIFICATE OF CORRECTION

PATENT NO. : 6,306,001 B1
DATED : October 23, 2001
INVENTOR(S) : Tamayo Hiroki

It is certified that error appears in the above-identified patent and that said Letters Patent is hereby corrected as shown below:

Title page,
Item [56], FOREIGN PATENT DOCUMENTS, insert -- 8-162001 6/96 (JP) --.

Column 1,
Line 31, "26, No. 1," should read -- Vol. 26, No. 1 --.

Column 13,
Line 24, "one-side" should read -- one side --.

Column 16,
Line 23, "OF" should read -- or --.

Column 17,
Line 7, "I'd1to" should read -- I' $_{d1}$ to --.

Signed and Sealed this

Tenth Day of September, 2002

*Attest:*

*Attesting Officer*

JAMES E. ROGAN
*Director of the United States Patent and Trademark Office*